US009402523B2

(12) United States Patent
Studebaker et al.

(10) Patent No.: US 9,402,523 B2
(45) Date of Patent: Aug. 2, 2016

(54) ROTARY SURFACE CLEANING TOOL

(76) Inventors: Roy Studebaker, Centralia, WA (US); William Edward Bruders, Sedro Woolley, WA (US); Brett Alan Bartholmey, Bellingham, WA (US); Bill Elmer Richardson, Prescott Valley, AZ (US); Kevin Andrew Wolfe, Burlington, WA (US)

( * ) Notice: Subject to any disclaimer, the term of this patent is extended or adjusted under 35 U.S.C. 154(b) by 846 days.

(21) Appl. No.: 13/065,096

(22) Filed: Mar. 14, 2011

(65) Prior Publication Data

US 2012/0233804 A1 Sep. 20, 2012

(51) Int. Cl.
*A47L 11/293* (2006.01)
*A47L 11/16* (2006.01)
*A47L 11/40* (2006.01)

(52) U.S. Cl.
CPC ..... *A47L 11/161* (2013.01); *A47L 11/4038* (2013.01); *A47L 11/4044* (2013.01); *A47L 11/4069* (2013.01)

(58) Field of Classification Search
CPC ..... A47L 11/161; A47L 11/4044; A47L 11/4038; A47L 11/4069
USPC ..... 15/320, 322
IPC ..... A47L 11/293
See application file for complete search history.

(56) References Cited

U.S. PATENT DOCUMENTS 695,162 A 3/1902 Lotz
791,567 A 6/1905 Moorhead
862,695 A 8/1907 Baldwin
1,654,727 A 1/1928 Green et al.
2,317,843 A 4/1943 Backlund
2,671,920 A 3/1954 Finnell
2,999,258 A 9/1961 Berberian
3,341,081 A 9/1967 King
3,381,326 A 5/1968 Dolan et al.
3,402,420 A 9/1968 Schaeffer
3,408,673 A 11/1968 Oxel
3,550,181 A 12/1970 Dolan et al.
3,623,177 A 11/1971 Pack
3,624,668 A 11/1971 Krause
3,649,995 A 3/1972 Ison
3,686,707 A 8/1972 Hughes et al.
3,696,689 A 10/1972 Senter et al.
3,720,977 A 3/1973 Brycki
3,755,850 A 9/1973 Porter
3,774,260 A 11/1973 Emus, Jr.
3,775,053 A 11/1973 Wisdom
(Continued)

FOREIGN PATENT DOCUMENTS

GB 2437484 10/2007

*Primary Examiner* — David Redding
(74) *Attorney, Agent, or Firm* — Charles J. Rupnick Attorney at Law

(57) ABSTRACT

A rotary surface cleaning machine for cleaning floors, including both carpeted floors and uncarpeted hard floor surfaces including but not limited to wood, tile, linoleum and natural stone flooring. The rotary surface cleaning machine has a rotary surface cleaning tool mounted on a frame and coupled for high speed rotary motion relative to the frame. The rotary surface cleaning tool has a substantially circular operational surface that performs the cleaning operation. The rotary surface cleaning tool is driven by an on-board power plant to rotate at high speed. The rotary surface cleaning tool is coupled to a supply of pressurized hot liquid solution of cleaning fluid and a powerful vacuum suction source.

6 Claims, 17 Drawing Sheets

(56) References Cited

U.S. PATENT DOCUMENTS

| | | | |
|---|---|---|---|
| 3,841,910 | A | 10/1974 | Baker |
| 4,006,506 | A | 2/1977 | Burgoon |
| 4,014,067 | A | 3/1977 | Bates |
| 4,074,385 | A | 2/1978 | Howard et al. |
| 4,075,733 | A | 2/1978 | Parise et al. |
| 4,083,077 | A | 4/1978 | Knight et al. |
| 4,088,462 | A | 5/1978 | Laule et al. |
| 4,095,309 | A | 6/1978 | Sundheim |
| 4,107,816 | A | 8/1978 | Matthews |
| 4,109,340 | A | 8/1978 | Bates |
| 4,120,070 | A | 10/1978 | Severin |
| 4,121,915 | A | 10/1978 | Anderson |
| 4,137,600 | A | 2/1979 | Albishausen |
| 4,139,922 | A | 2/1979 | Fitch |
| 4,146,944 | A | 4/1979 | Pinto |
| 4,153,968 | A | 5/1979 | Perkins |
| 4,154,578 | A | 5/1979 | Bane |
| 4,158,248 | A | 6/1979 | Palmer |
| 4,161,802 | A | 7/1979 | Knight et al. |
| 4,166,368 | A | 9/1979 | Beninca' et al. |
| 4,167,799 | A | 9/1979 | Webb |
| 4,182,001 | A | 1/1980 | Krause |
| 4,186,459 | A | 2/1980 | Wulff |
| 4,191,590 | A | 3/1980 | Sundheim |
| 4,194,262 | A | 3/1980 | Finley et al. |
| 4,196,492 | A | 4/1980 | Johnson et al. |
| 4,207,649 | A | 6/1980 | Bates |
| 4,210,978 | A | 7/1980 | Johnson et al. |
| 4,219,902 | A | 9/1980 | DeMaagd |
| 4,227,893 | A | 10/1980 | Shaddock |
| 4,234,995 | A | 11/1980 | Parise |
| 4,240,569 | A | 12/1980 | Bessinger |
| 4,244,079 | A | 1/1981 | Bane |
| 4,264,999 | A | 5/1981 | Monson |
| 4,267,618 | A | 5/1981 | Cuscovitch |
| 4,268,935 | A | 5/1981 | Bessinger |
| 4,270,238 | A | 6/1981 | Shallenberg et al. |
| 4,272,861 | A | 6/1981 | Notta et al. |
| 4,282,626 | A | 8/1981 | Schneider |
| 4,284,127 | A | 8/1981 | Collier et al. |
| 4,330,084 | A | 5/1982 | Buchner et al. |
| 4,333,204 | A | 6/1982 | Monson |
| 4,335,486 | A | 6/1982 | Kochte |
| 4,339,840 | A | 7/1982 | Monson |
| 4,349,935 | A | 9/1982 | Knestele |
| 4,353,145 | A | 10/1982 | Woodford |
| 4,360,946 | A | 11/1982 | Marshall, Jr. et al. |
| 4,392,270 | A | 7/1983 | Magee |
| 4,400,846 | A | 8/1983 | Sanderson |
| 4,407,041 | A | 10/1983 | Goldsmith |
| 4,441,229 | A | 4/1984 | Monson |
| 4,457,042 | A | 7/1984 | Jones et al. |
| 4,458,377 | A | 7/1984 | Frohbieter |
| 4,488,330 | A | 12/1984 | Grave |
| 4,521,935 | A | 6/1985 | Johnson |
| 4,534,746 | A | 8/1985 | Hausinger |
| 4,595,420 | A | 6/1986 | Williams, III et al. |
| 4,649,594 | A | 3/1987 | Grave |
| 4,654,925 | A | 4/1987 | Grave |
| 4,692,959 | A | 9/1987 | Monson |
| 4,696,974 | A | 9/1987 | Cavelli |
| 4,720,889 | A | 1/1988 | Grave |
| 4,809,397 | A | 3/1989 | Jacobs et al. |
| 4,862,551 | A | 9/1989 | Martinez et al. |
| 4,879,784 | A | 11/1989 | Shero |
| 5,101,532 | A | 4/1992 | Dyson |
| 5,103,527 | A | 4/1992 | Holland |
| 5,105,503 | A | 4/1992 | Holland |
| 5,116,425 | A | 5/1992 | Ruef |
| 5,157,805 | A | 10/1992 | Pinter |
| 5,165,139 | A | 11/1992 | Oxman |
| 5,218,737 | A | 6/1993 | Dansby et al. |
| 5,249,325 | A | 10/1993 | Wilen |
| 5,287,591 | A | 2/1994 | Rench et al. |
| 5,347,678 | A | 9/1994 | Williams et al. |
| 5,363,535 | A | 11/1994 | Rench et al. |
| 5,371,918 | A | 12/1994 | Shero |
| 5,394,585 | A | 3/1995 | Connelly |
| 5,430,910 | A | 7/1995 | Wiley |
| 5,438,728 | A | 8/1995 | Kubes et al. |
| 5,463,791 | A | 11/1995 | Roden |
| 5,465,456 | A | 11/1995 | Fellhauer et al. |
| 5,485,651 | A | 1/1996 | Payeur |
| 5,485,652 | A | 1/1996 | Holland |
| 5,522,114 | A | 6/1996 | Allison |
| 5,555,598 | A | 9/1996 | Grave et al. |
| 5,555,599 | A | 9/1996 | Markley |
| 5,561,884 | A | 10/1996 | Nijland et al. |
| 5,587,021 | A | 12/1996 | Hoersch et al. |
| 5,596,788 | A | 1/1997 | Linville et al. |
| 5,613,271 | A | 3/1997 | Thomas |
| 5,632,670 | A | 5/1997 | Gwyther |
| 5,752,289 | A | 5/1998 | Collins |
| 5,815,869 | A | 10/1998 | Hopkins |
| 5,867,861 | A | 2/1999 | Kasen et al. |
| 6,016,973 | A | 1/2000 | Thompson et al. |
| 6,032,326 | A | 3/2000 | Roden et al. |
| 6,052,854 | A | 4/2000 | Besel et al. |
| 6,125,495 | A | 10/2000 | Berg et al. |
| 6,151,748 | A | 11/2000 | Earhart, Jr. et al. |
| 6,192,547 | B1 | 2/2001 | Song |
| 6,243,914 | B1 | 6/2001 | Studebaker |
| 6,266,892 | B1 | 7/2001 | Haynie |
| 6,298,577 | B1 | 10/2001 | Haynie |
| 6,367,109 | B1 | 4/2002 | Besel et al. |
| 6,560,817 | B2 | 5/2003 | Deiterman et al. |
| 6,684,452 | B2 | 2/2004 | Lehman et al. |
| 6,705,332 | B2 | 3/2004 | Field et al. |
| 6,789,290 | B2 | 9/2004 | Kent et al. |
| 6,981,338 | B2 | 1/2006 | Jensen et al. |
| 7,070,662 | B2 | 7/2006 | Studebaker |
| RE39,422 | E | 12/2006 | Clemons |
| RE39,623 | E | 5/2007 | Studebaker |
| 7,299,521 | B2 | 11/2007 | Theiss, Jr. et al. |
| 7,370,386 | B2 | 5/2008 | Lehman et al. |
| 7,530,135 | B2 | 5/2009 | Benedict |
| RE41,367 | E | 6/2010 | Studebaker |
| 7,758,702 | B1 | 7/2010 | Huffman |
| 7,793,385 | B2 | 9/2010 | Huffman |
| 8,453,293 | B1 * | 6/2013 | Monson ..... 15/322 |
| 2006/0143843 | A1 | 7/2006 | Benedict |
| 2007/0251047 | A1 * | 11/2007 | Monson ..... 15/322 |
| 2008/0141483 | A1 | 6/2008 | Pearlstein |

* cited by examiner

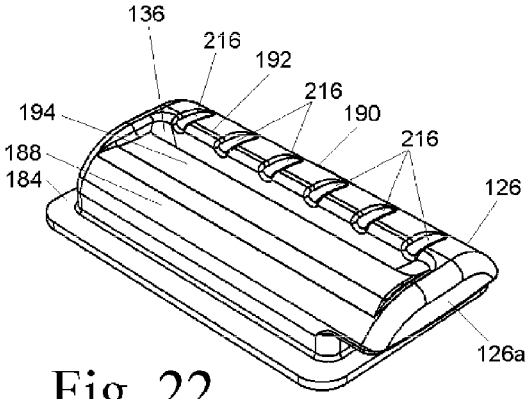
Fig. 22
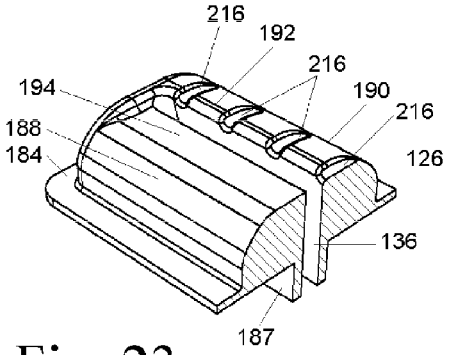
Fig. 23
Fig. 24
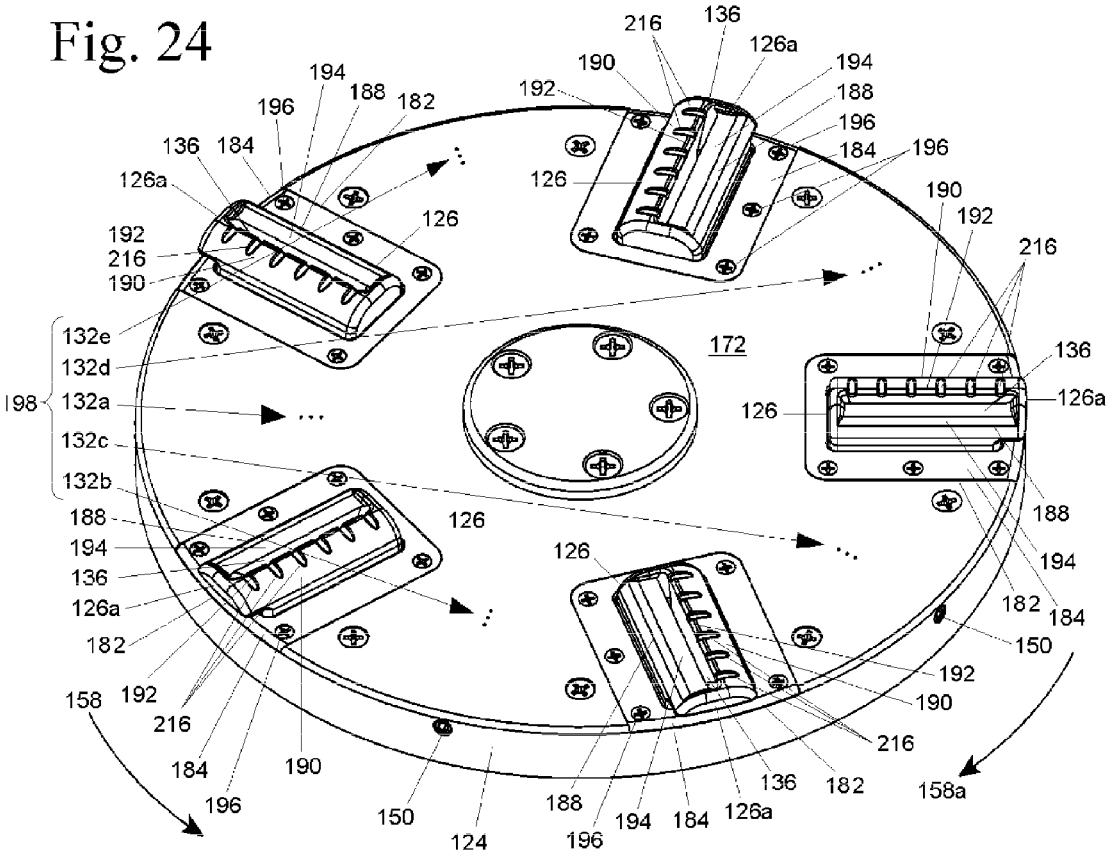

ROTARY SURFACE CLEANING TOOL

FIELD OF THE INVENTION

The present invention relates generally to a rotary tool for cleaning surfaces, including rugs and carpets, and in particular to such apparatus and methods with brushes for coaction with cleaning liquid delivering means and suction extraction means.

BACKGROUND OF THE INVENTION

Many apparatuses and methods are known for cleaning carpeting and other flooring, wall and upholstery surfaces. The cleaning apparatuses and methods most commonly used today apply cleaning fluid as a spray under pressure to the surface whereupon the cleaning fluid dissolves the dirt and stains and the apparatus scrubs the fibers while simultaneously applying suction to extract the cleaning fluid and the dissolved soil. Many different apparatuses and methods for spraying cleaning fluid under pressure and then removing it with suction are illustrated in the prior art. Some of these cleaning apparatuses and methods use a rotating device wherein the entire machine is transported over the carpeting while a cleaning head is rotated about a vertical axis.

Another category of carpeting and upholstery cleaning apparatuses and methods using the rotating device wherein the entire machine is transported over the carpeting while a cleaning head is rotated about a vertical axis includes machines having a plurality of arms, each of having one or more spray nozzles or a suction means coupled to a vacuum source. These rotary cleaning tools providing a more intense scrubbing action since, in general, more scrubbing surfaces contact the carpet. These apparatuses and methods are primarily illustrated in U.S. Pat. No. 4,441,229 granted to Monson on Apr. 10, 1984, and are listed in the prior art known to the inventor but not discussed in detail herein.

A third category of carpeting and upholstery cleaning apparatuses and methods that attempt to deflect or otherwise control the cleaning fluid are illustrated by U.S. Pat. No. 6,243,914, which was granted to the inventor of the present patent application Jun. 12, 2001, and which is incorporated herein by reference. U.S. Pat. No. 6,243,914 discloses a cleaning head for carpets, walls or upholstery, having a rigid open-bottomed main body that defines a surface subjected to the cleaning process. Mounted within or adjacent to the main body and coplanar with the bottom thereof is a fluid-applying device which includes a slot at an acute angle to the plane of the bottom of the body located adjacent the plane of the bottom of the body, the slot configured such that the fluid is applied in a thin sheet that flows out of the slot and into the upper portion of the surface to be cleaned and is subsequently extracted by suction into the vacuum source for recovery. The cleaning head is alternatively multiply embodied in a plurality of arms which are rotated about a hub.

FIG. 1 illustrates a typical prior art professional fluid cleaning system as illustrated in U.S. Pat. No. 6,243,914. It is to be understood that this cleaning system is typically mounted in a van or truck for mobile servicing of carpets and flooring in homes and businesses. The typical truck-mounted fluid cleaning system 1 includes a main liquid waste receptacle 3 into which soiled cleaning fluid is routed. A cleaning head or nozzle 5 is mounted on a rigid vacuum wand 7 which includes a handle 8 for controlling cleaning head 5. A supply of pressurized hot liquid solution of cleaning fluid is supplied to cleaning head 5 via a cleaning solution delivery tube 9 arranged in fluid communication with a cleaning solution inlet orifice 11 of cleaning head 5 for delivering there through a flow of pressurized liquid cleaning solution to fluid cleaning solution spray jets 13 of cleaning head 5. Carpet cleaning head 5 typically includes a rectangular, downwardly open truncated pyramidal envelope 15 which contains the cleaning fluid spray that is applied to the carpet or other flooring, as well as forming a vacuum plenum for the vacuum retrieving the soiled liquid for transport to waste receptacle 3. An intake port 16 of the vacuum wand 7 is coupled in fluid communication with the vacuum plenum of cleaning head 5.

Mounted above the main waste receptacle 3 is a cabinet 17 housing a vacuum source and supply of pressurized hot liquid cleaning fluid. Soiled cleaning fluid is routed from cleaning head 5 into waste receptacle 3 via rigid vacuum wand 7 and a flexible vacuum return hose 19 coupled in fluid communication with an exhaust port 20 thereof, whereby spent cleaning solution and dissolved soil are withdrawn under a vacuum force supplied by the fluid cleaning system, as is well known in the art. A vacuum control valve or switch 21 is provided for controlling the vacuum source.

FIG. 2 illustrates details of operation of the typical truck-mounted fluid cleaning system 1 illustrated in FIG. 1. Here, the main waste receptacle 3, as well as the vacuum source and cleaning fluid supply cabinet 17, are shown in partial cutaway views for exposing details thereof. The cleaning fluid is drawn through cleaning solution delivery tube 9 from a supply 23 of liquid cleaning solution in the cabinet 17. The vacuum for vacuum return hose 19 is provided by a vacuum suction source 25, such as a high pressure blower, driven by a power supply 27. The blower vacuum source 25 communicates with the main waste receptacle 3 through an air intake 29 coupled into an upper portion 31 thereof and, when operating, develops a powerful vacuum in an air chamber 33 enclosed in the receptacle 3.

Vacuum return hose 19 is coupled in communication with waste receptacle 3 through a drain 35, for example, at upper portion 31, remote from intake 29. Vacuum return hose 19 feeds soiled cleaning fluid into waste receptacle 3 as a flow 37 of liquid soiled with dissolved dust, dirt and stains, as well as undissolved particulate material picked up by the vacuum return but of a size or nature as to be undissolvable in the liquid cleaning fluid. The flow 37 of soiled cleaning fluid enters into waste receptacle 3 through drain 35 and forms a pool 39 of soiled liquid filled with dissolved and undissolved debris. A float switch 41 or other means avoids overfilling the waste receptacle 3 and inundating the blower 25 through its air intake 29. A screen or simple filter may be applied to remove gross contaminates from the soiled liquid flow 37 before it reaches the pool 39, but this is a matter of operator choice since any impediment to the flow 37 reduces crucial vacuum pressure at the cleaning head 5 for retrieving the soiled liquid from the cleaned carpet or other surface.

Soiled liquid cleaning fluid effectively filters air drawn into the waste receptacle 3 by dissolving the majority of dust, dirt and stains, and drowning and sinking any undissolved debris whereby it is sunk into the pool 39 of soiled liquid and captured therein. Thus, the soiled liquid in the vacuum return hose 19 effectively filters the air before it is discharged into the enclosed air chamber 34, and no airborne particles of dust and dirt are available to escape into the enclosed air chamber 33 floating above the liquid pool 39.

In a rotary surface cleaning tool, cleaning head 5 utilizes cleaning liquid delivering means and suction extraction means in combination with a rotary cleaning plate that is coupled for high speed rotary motion.

One example of a rotary surface cleaning tool is illustrated by U.S. Pat. No. 4,182,001, SURFACE CLEANING AND RINSING DEVICE, issued to Helmuth W. Krause on Jan. 8, 1980, which is incorporated herein by reference.

FIG. 3 illustrates the rotary surface cleaning and rinsing machine of Krause, indicated generally at 50, which includes a substantially circular housing 51 and frame 53 with its lower axial face open at 55, with this face 55 being disposed substantially parallel to the surface which is to be cleaned, such as a rug 57. Mounted on top of the housing 51 and frame 53 is an enclosure 59 from which extends a handle assembly 61. Handle assembly 61 is held by the operator during the manipulation of machine 50. Handle assembly 61 has operating levers 63 and 65. Control handle 65 regulates flow of cleaning or rinsing fluid to rotary surface cleaning tool 51 through feed line 67. For example, feed line 67 is coupled to cleaning solution delivery tube 9 from supply 23 of liquid cleaning solution in cabinet 17 in a truck-mounted unit, or another supply of liquid cleaning solution. Control handle 63 can be used to regulate the starting and stopping of drive motors.

An exhaust pipe or tube 69 is mounted on handle assembly 61 and is connected to the top of rotary surface cleaning tool 51 at a connection 71. Suction is created by the motor and fan assembly 73. Else, exhaust pipe or tube 69 is coupled for suction extraction to vacuum return hose 19 and vacuum source 25 in a truck-mounted unit. Soiled cleaning fluid extracted by suction extraction from carpet or rug 57 is drawn off through outlet connection 71 and through discharge hose 69. Frame 53 may also be supported by a swivel wheel 75. A large rotor 77 is rotationally mounted within housing 51 and rotationally coupled within enclosure 59. Rotor 77 is drivingly connected by a drive belt or chain 79 to an output shaft 81 of an electric motor 83 mounted on the frame 53. Motor 83 serves to turn large rotor 77. A plurality of circular brushes 85 are located on rotor 77.

FIG. 4 illustrates brushes 85 are rotated as shown by arrows 87 in the opposite direction from the turning motion 89 of the rotor 77 by a rotating drive means for contrarotating brushes 85 with respect to rotor 77. Moreover, brushes 85 are rotated at significantly higher revolutions per minute (RPM) than rotor 77 for producing a very vigorous brush scrubbing action. For example, brushes 85 rotate more than seven times with respect to rug 57 for each full rotation of rotor 77. As a result, the brush elements or bristles in the peripheral region travelling very rapidly in a backward direction 87 relative to rotor 77 tend to lift up and to flip over the matted pile of rug 57 thereby exposing and scrubbing its underside. Then, in interior regions 91 where brush elements or bristles are travelling in the same direction as rotor 77, they flip the pile back into its original position for scrubbing it on the other side. Thus, the pile of rug 57 becomes thoroughly scrubbed on its underside as well as on its upper side. A cyclic scrubbing action is produced flipping the matted pile back and forth many times during one pass of machine 50.

Also positioned on rotor 77 are suction extraction nozzles 93 spaced between brushes 85 and communicating with discharge hose 69. Suction extraction nozzles 93 are fixed to rotor 77 and each is provided with a relatively narrow vacuum extraction slot 95. Each vacuum extraction slot 95 is positioned coplanar with the ends of the brush elements or bristles of brushes 85 distal from rotor 77.

Also mounted on rotor 77 is a plurality of spray nozzle means 97 for dispensing cleaning or rinsing liquid. Each of spray nozzle means 97 can be mounted for angular adjustment so as to direct sprays of cleaning or rinsing liquid through individual nozzles 99 onto rug 57 at different angles. The cleaning or rinsing fluid is conveyed to nozzle means 97 through line 67 which leads to a supply of cleaning or rinsing fluid, such as either feed line 67 or solution delivery tube 9.

During operation of the cleaning device, rotor 77 rotates in the direction indicated by arrow 89. As the cleaning liquid is sprayed onto rug 57 through nozzles 99, rotating brushes 85 agitate the pile of rug 57 in conjunction with the cleaning liquid to loosen dirt in or on the surface. The spent cleaning liquid and loosened dirt are extracted up by the next succeeding suction extraction nozzle 93. Accordingly, the liquid-dwell-time is solely controlled by machine 50, and not by the rate at which the operator advances machine 50 over the floor.

However, known rotary surface cleaning tool are limited in their ability to effectively provide the desired cleaning of target floor surfaces and extraction of soiled cleaning liquid.

SUMMARY OF THE INVENTION

The present invention is a rotary surface cleaning machine for cleaning floors, including both carpeted floors and uncarpeted hard floor surfaces including but not limited to wood, tile, linoleum and natural stone flooring. The rotary surface cleaning machine has a rotary surface cleaning tool mounted on a frame and coupled for high speed rotary motion relative to the frame. The rotary surface cleaning tool has a substantially circular operational surface that performs the cleaning operation. The rotary surface cleaning tool is driven by an on-board power plant to rotate at a high rate. The rotary surface cleaning tool is coupled to a supply of pressurized hot liquid solution of cleaning fluid and a powerful vacuum suction source.

According to one aspect of the invention a plurality of individual arrays of cleaning solution delivery spray nozzles are substantially uniformly angularly distributed across the operational surface of the rotary surface cleaning tool, the arrays of spray nozzles being coupled in fluid communication with a pressurized flow of cleaning fluid through a plurality of individual liquid cleaning fluid distribution channels of a cleaning fluid distribution manifold portion of the rotary surface cleaning tool. Each of the plurality of individual arrays of cleaning solution delivery spray nozzles includes a plurality of individual delivery spray nozzles that are radially oriented across the substantially circular operational surface of the rotary surface cleaning tool, and each individual array of the spray nozzles extends across a portion of the operational surface that is substantially less than an annular portion thereof extended between an inner radial limit and an outer radial limit. Individual ones of the arrays of spray nozzles are positioned in a substantially spiral pattern across the annular portion of the operational surface of the rotary surface cleaning tool between the inner radial limit of the annular portion and receding therefrom over the annular portion toward the outer radial limit thereof.

This spiral pattern of individual array of spray nozzles greatly reduces the number of individual delivery spray nozzles that must be supplied on the operational surface of the rotary surface cleaning tool. However, the high speed of rotation ensures that sufficient quantities of cleaning solution is delivered since each individual array of spray nozzles is presented to the target floor area at least one, two or several times each second. The spray nozzles are very expensive to drill or otherwise form because they are only about $1/10{,}000$th of an inch in diameter. Therefore, a large cost savings is gained, while the delivery of cleaning solution does not suffer. Forming the array of spray nozzles in the spiral pattern so that the individual array of spray nozzles to cover only a fractional portion of the operational surface of the rotary surface cleaning tool also ensures that the cleaning solution is delivered with substantially uniform pressure across the entire radius of the rotary surface cleaning tool, without resorting to special design features normally required in the prior art to provide uniform pressure across each spray nozzle array that extends across at least a large portion of radius of the rotary surface cleaning tool, or else the entire radius.

According to another aspect of the invention a plurality of suction extraction shoes are also substantially uniformly angularly distributed across the operational surface of the rotary surface cleaning tool alternately between the arrays of cleaning solution delivery spray nozzles and are projected from the operational surface of the rotary surface cleaning tool by a biasing means that is structured for individually biasing each suction extraction shoe outwardly relative to bottom operational surface of the rotary surface cleaning tool. For example, a resilient cushion, such as a closed foam rubber cushion of about one-quarter inch thickness or thereabout, is positioned between a flange portion of each shoe and the rotary surface cleaning tool.

Each of the suction extraction shoes is further formed with a fluid extraction passage presented in a position adjacent to the operational surface of the rotary surface cleaning tool. The fluid extraction passage of each suction extraction shoe communicates through one of a plurality of plenum branch passages within the rotary surface cleaning tool with a vacuum plenum that is in fluid communication with the vacuum suction source.

According to another aspect of the invention the rotary surface cleaning tool has a target surface scrubbing means for causing a washboard-type scrubbing effect of a moveable target surface to be cleaned, i.e., a carpet. The target surface scrubbing means causes oscillations of the moveable target surface alternately toward and away from the operational surface of the rotary surface cleaning tool by alternate application of vacuum suction pulling the carpet toward the operational surface of the rotary surface cleaning tool and application of compression by the next consecutive shoe pushing the carpet away from the operational surface of the rotary surface cleaning tool.

According to another aspect of the invention the target surface scrubbing means for causing a washboard-type scrubbing effect is one or both of (a) a relatively raised surface portion of each suction extraction shoe that projects further from the operational surface of the rotary surface cleaning tool than a relatively lower surface portion thereof, and (b) one or more rows of bristle brushes arranged along a surface portion of each suction extraction shoe and projected further from the operational surface of the rotary surface cleaning tool than a surface of the corresponding suction extraction shoe. The relatively raised surface portion of each suction extraction shoe, or the one or more rows of bristle brushes, whichever is present, the leading surface portion of the suction extraction shoe as a function of a direction of the rotary motion of the operational surface of the rotary surface cleaning tool, while the relatively lower surface or brushless portion forms the trailing surface portion of the suction extraction shoe.

When present, the rows of bristle brushes provide a more aggressive cleaning action in cleaning when provided in combination with fluid cleaning of carpet or other target flooring surface. Furthermore, when present the optional raised bristle brushes effectively raise bottom operational surface of the rotary surface cleaning tool slightly away from target floor surface so that the rotary surface cleaning machine can be alternated between carpeting and hard floor surfaces such as wood, tile, linoleum and natural stone flooring, without possibility of scarring or other damage to either the operational surface of the rotary surface cleaning tool or the hard floor surfaces.

Other aspects of the invention are detailed herein.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein:

FIG. 22 is a detail view of another embodiment of the suction extraction shoe of the rotary surface cleaning machine illustrated in FIG. 5 through FIG. 9, wherein each suction extraction shoe is structured for accomplishing the "washboard" scrubbing effect of the moveable target surface, i.e. carpet surface, independently of the next consecutive suction extraction shoe;

FIG. 23 is a detailed cross-section view of the embodiment of the suction extraction shoe illustrated in FIG. 22, wherein the suction extraction shoe is shown as having the optional relatively lower or recessed portion formed on the leading surface and the relatively raised portion is formed on the trailing surface as a function of the reversed clockwise rotational direction of the rotary surface cleaning tool; and FIG. 24 illustrates the bottom operational surface of the rotary surface cleaning tool of the rotary surface cleaning machine illustrated in FIG. 5 through FIG. 9, having the suction extraction shoe formed with the optional relatively lower or recessed surface portion on its leading surface, and the optional relatively raised surface portion formed on the trailing surface as illustrated in FIG. 22 and FIG. 23.

DETAILED DESCRIPTION OF PREFERRED EMBODIMENT

In the Figures, like numerals indicate like elements.

Figure 5:
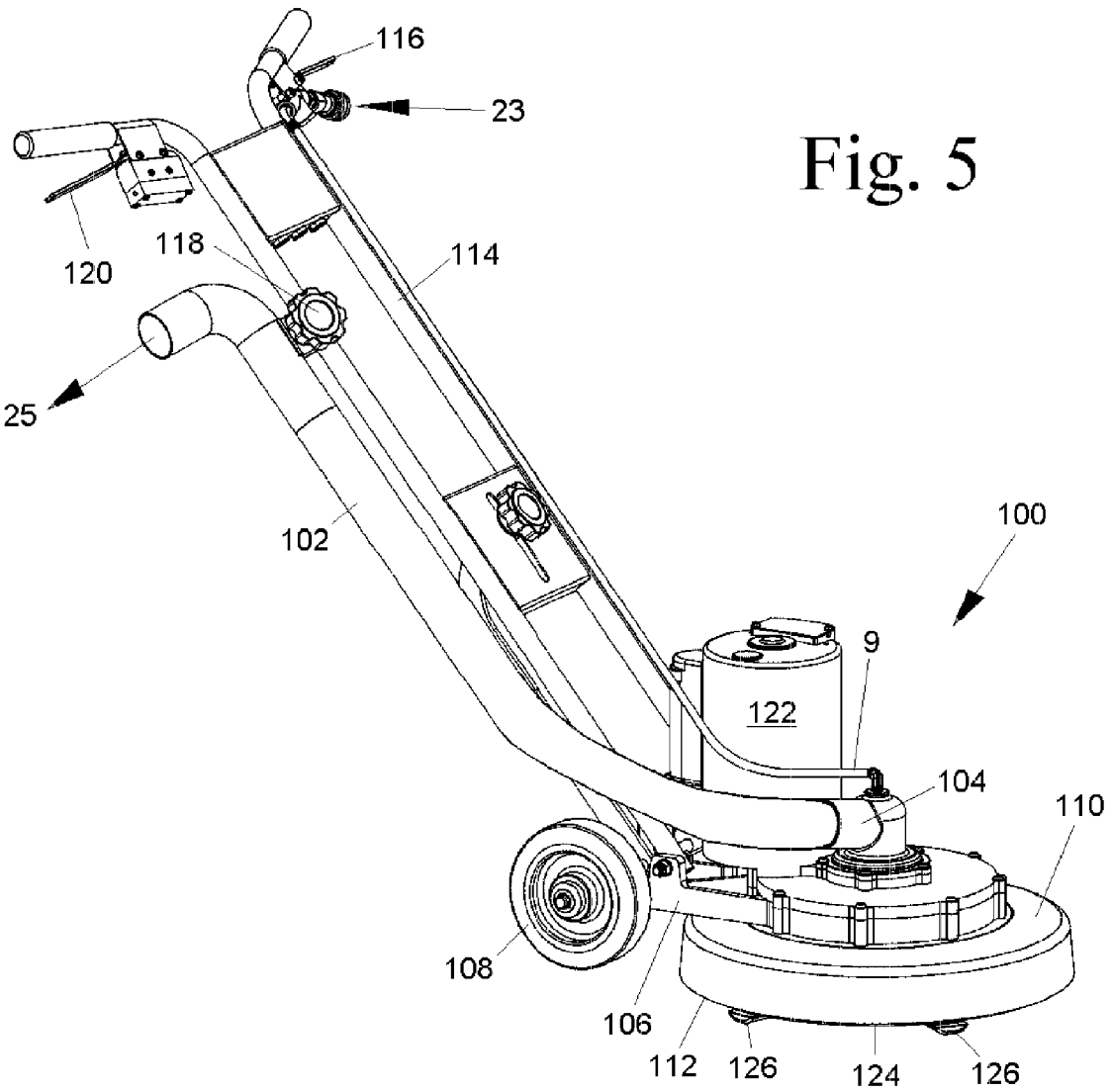
FIG. 5 illustrates the rotary surface cleaning machine of the invention for delivery of liquid cleaning fluid to a target surface to be cleaned, such as either carpeting or hard floor surfaces including but not limited to wood, tile, linoleum and natural stone flooring.

FIG. 5 illustrates a rotary surface cleaning machine 100 of a type for delivery of liquid cleaning fluid to a target surface to be cleaned, such as either carpeting or hard floor surfaces including but not limited to wood, tile, linoleum and natural stone flooring. Rotary surface cleaning machine 100 is coupled to draw liquid cleaning fluid through cleaning solution delivery tube 9 from a supply 23 of liquid cleaning solution in the cabinet 17.

Figure 1:
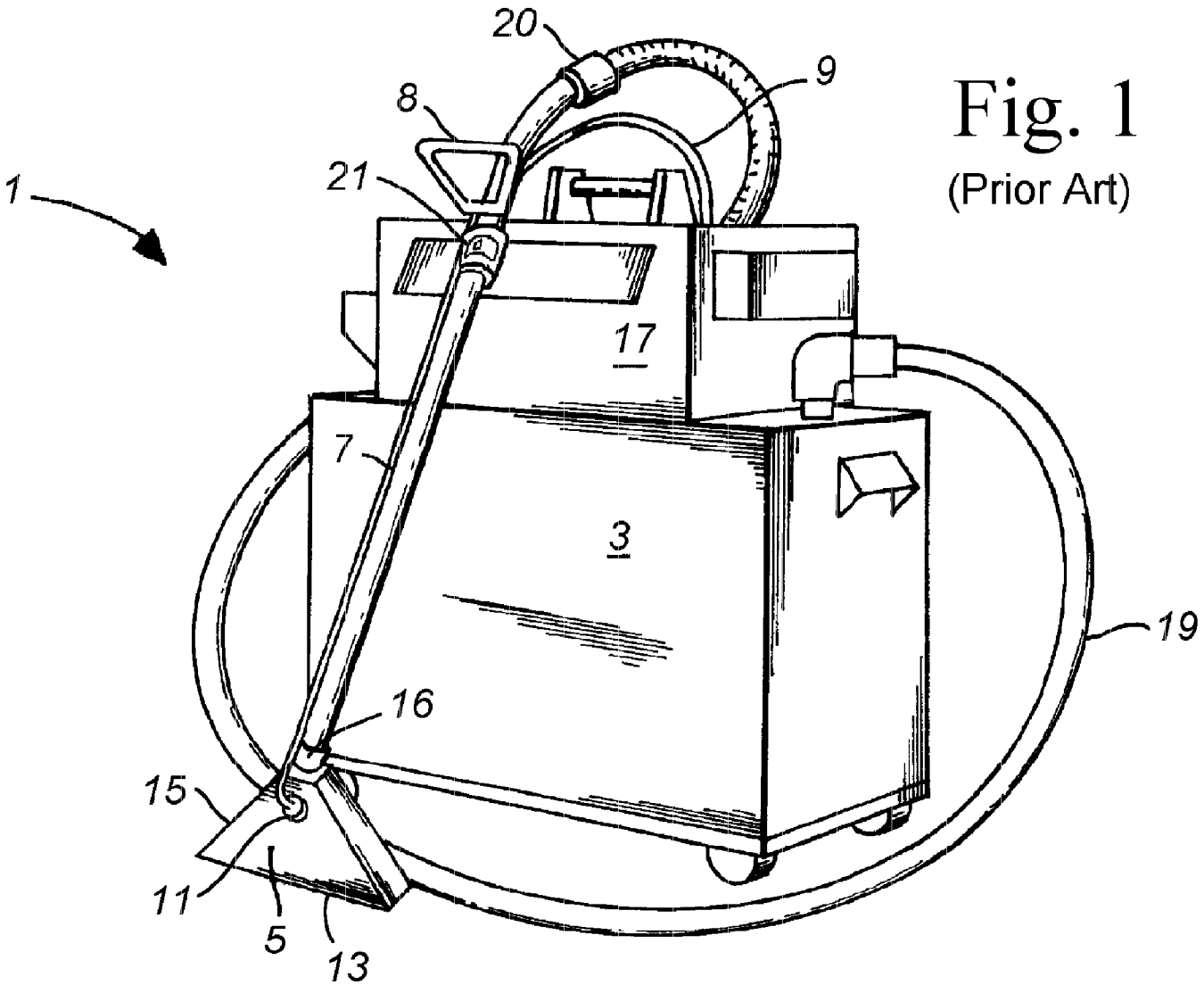
Fig. 1 (Prior Art)
FIG. 1 illustrates a typical prior art professional fluid cleaning system of a type that is typically mounted in a van or truck for mobile servicing of carpets and flooring in homes and businesses.
Figure 2:
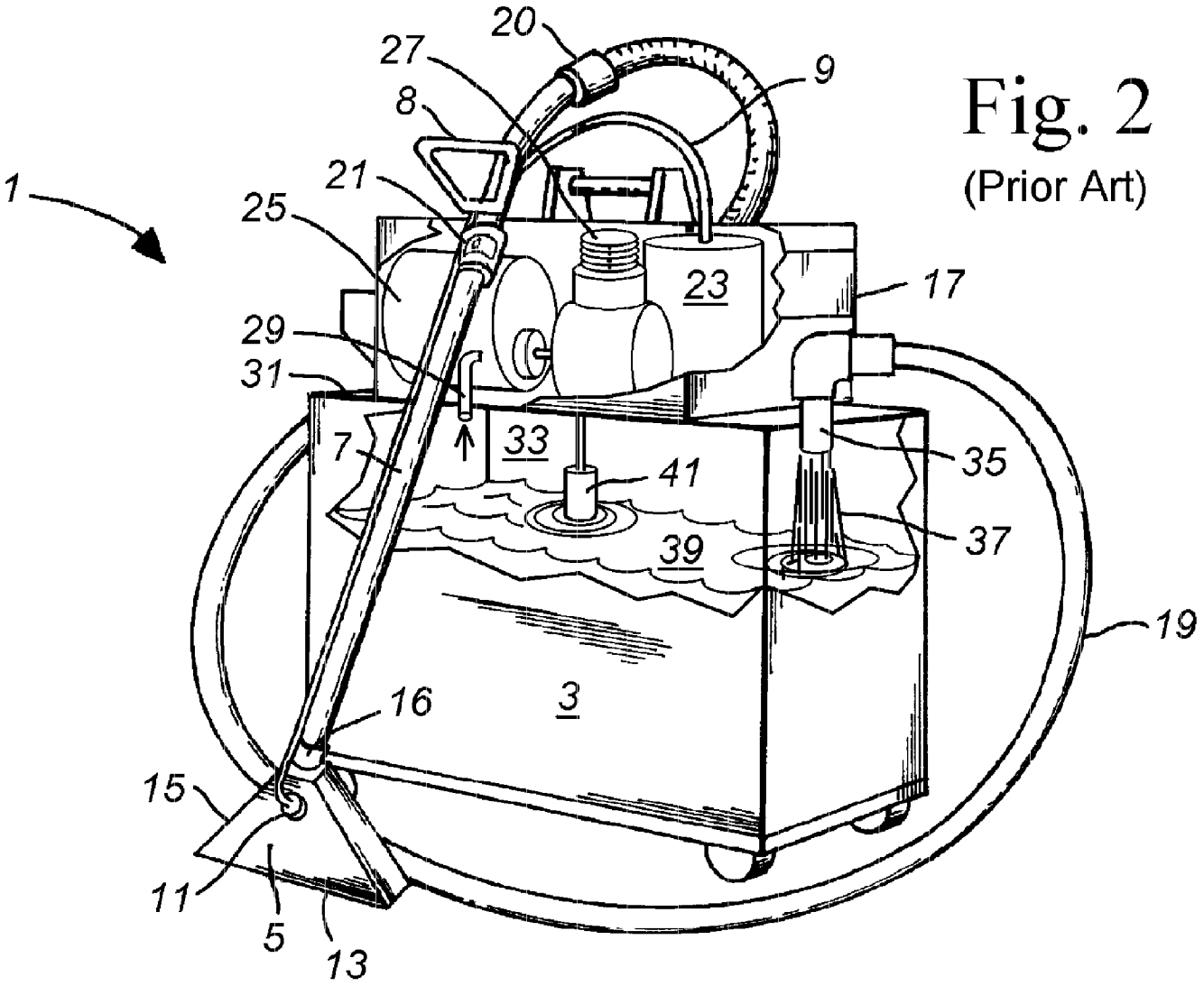
Fig. 2 (Prior Art)
FIG. 2 illustrates details of operation of the typical truck-mounted fluid cleaning system illustrated in FIG. 1.
Figure 3:
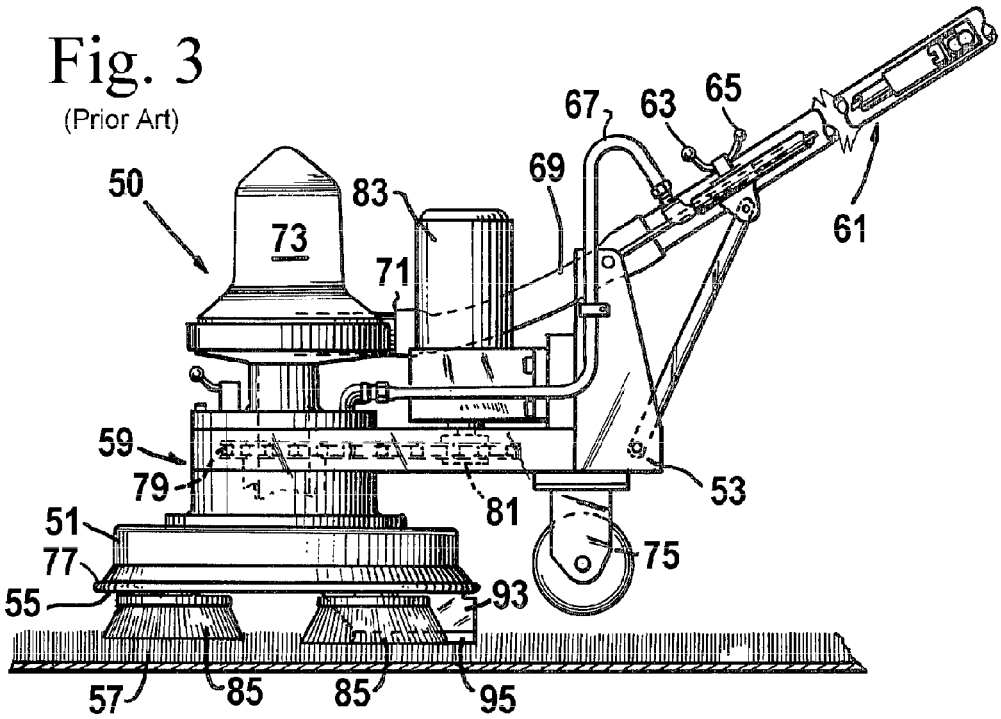
Fig. 3 (Prior Art)
FIG. 3 illustrates one rotary surface cleaning and rinsing machine of the prior art.
Figure 4:
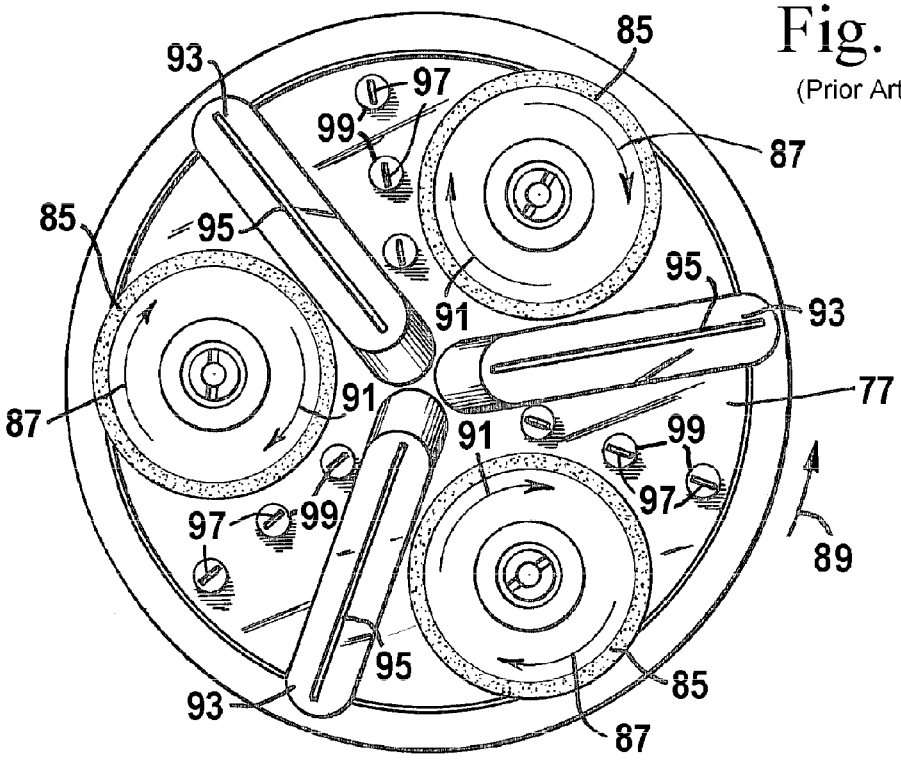
Fig. 4 (Prior Art)
FIG. 4 is another view of the rotary surface cleaning and rinsing machine of the prior art as illustrated in FIG. 3.

Rotary surface cleaning machine 100 is optionally a standalone unit coupled to a supply of pressurized hot liquid solution of cleaning fluid and a having an on-board motor or other power plant coupled for driving a fan assembly for generating a suction as, for example, rotary tool for cleaning surfaces disclosed by U.S. Pat. No. 4,182,001, which is incorporated herein by reference. Alternatively, rotary surface cleaning machine 100 is part of a truck-mounted fluid cleaning system such as illustrated in FIG. 1 and FIG. 2 and disclosed in U.S. Pat. No. 6,243,914, which is incorporated herein by reference. When part of a truck-mounted fluid cleaning system, rotary surface cleaning machine 100 is coupled to vacuum return hose 19 and truck-mounted vacuum source 25 by means of an exhaust pipe or hose 102 coupled to an exhaust port 104. Fluid extraction suction is generated by the vacuum force supplied by vacuum source 25. Soiled cleaning fluid extracted from carpet or rug 57 is drawn off through exhaust port 104 and carried through flexible vacuum return hose 19 to main waste receptacle 3.

As illustrated here by example and without limitation, rotary surface cleaning machine 100 includes a support frame member 106, which may be supported by a wheel assembly 108. Support frame 106 carries a substantially circular housing 110 having its lower axial face open at 112 with this face 112 being disposed substantially parallel to the surface which is to be cleaned, such as rug 57. A pivotally mounted handle assembly 114 is used by the operator during operation for manipulating machine 100. Handle assembly 114 supports one or more operating control mechanisms mounted thereon for the convenience of the operator. For example, one flow control mechanism 116 regulates flow of cleaning fluid through cleaning solution delivery tube 9. A conventional quick connection can be used for supplying the liquid cleaning solution. Another vacuum control mechanism 118 can be used to regulate the suction extraction of spent cleaning liquid and loosened dirt. A rotary control mechanism 120 can be used to regulate the starting and stopping of the rotary surface cleaning tool through control of an on-board power plant 122, such as an electric motor or other power plant, mounted on support frame 106.

A rotary surface cleaning tool 124 is configured as a large rotor that is journaled with support frame 106 for high speed rotary motion within circular housing 110. On-board power plant 122 is coupled for driving the high speed rotary motion of rotary surface cleaning tool 124.

A plurality of suction extraction shoes 126 are located on rotary surface cleaning tool 124 and project from open lower axial face 112 of circular housing 110. Each suction extraction shoe 126 is coupled in fluid communication with vacuum source 25 through exhaust port 104 and exhaust pipe or hose 102 for the suction extraction of spent cleaning liquid and loosened dirt.

Figure 6:
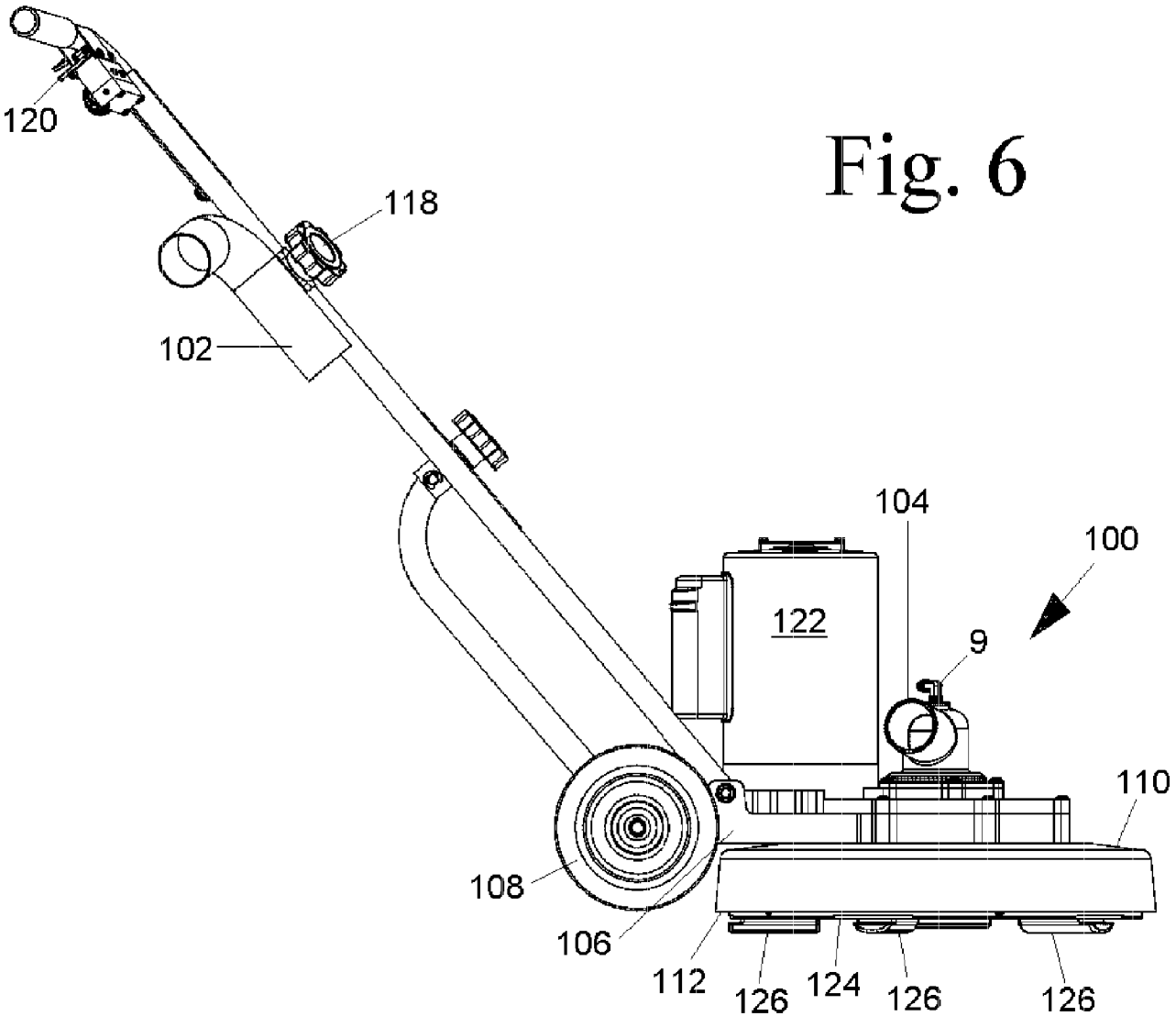
FIG. 6 is a side view of the rotary surface cleaning machine illustrated in FIG. 5, wherein a plurality of suction extraction shoes are more clearly illustrated as being located on a rotary surface cleaning tool and projected from an open lower axial face of a circular housing.

FIG. 6 is a side view of the rotary surface cleaning machine 100 illustrated in FIG. 5, wherein the plurality of suction extraction shoes 126 are more clearly illustrated as being located on rotary surface cleaning tool 124 and projected from open lower axial face 112 of circular housing 110.

Figure 7:
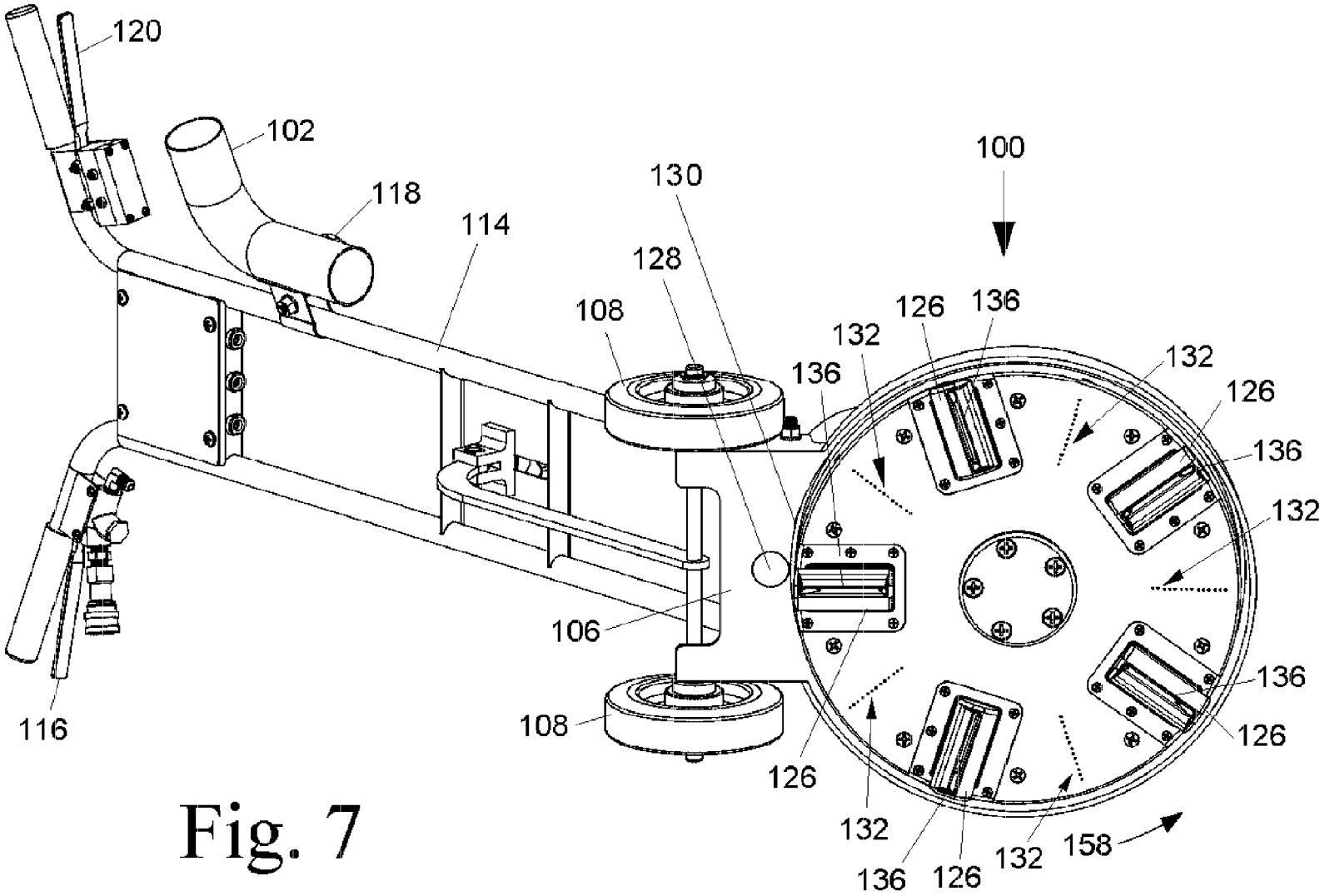
FIG. 7 is a bottom view of the rotary surface cleaning machine illustrated in FIG. 5 and FIG. 6, wherein the plurality of suction extraction shoes are more clearly illustrated as being located on the rotary surface cleaning tool in the open lower axial face of the circular housing.

FIG. 7 is a bottom view of the rotary surface cleaning machine 100 illustrated in FIG. 5 and FIG. 6, wherein the plurality of suction extraction shoes 126 are more clearly illustrated as being located on rotary surface cleaning tool 124 in open lower axial face 112 of circular housing 110.

As disclosed herein, a rotary drive output 128 of on-board power plant 122 is coupled for driving the high speed rotary motion of rotary surface cleaning tool 124. For example, rotary surface cleaning tool 124 is rotationally mounted within housing 110 and is drivingly connected, for example but without limitation by any of: a drive belt, a drive chain, or a drive gear, to rotary drive output 128 of on-board power plant 122 mounted on frame 106. Here, by example and without limitation, rotary drive output 128 of on-board power plant 122 is a drive gear coupled to drive a circumferential tooth gear 130 disposed about the circumference of rotary surface cleaning tool 124. Accordingly, drive means alternative to the rotary gear drive disclosed herein by example and without limitation are also contemplated and may be substituted without deviating from the scope and intent of the present invention. Power plant 122 thus serves to turn rotary surface cleaning tool 124 at a high speed rotary motion under the control of rotary control mechanism 120.

Rotary surface cleaning tool 124 includes a plurality of arrays 132 of cleaning solution delivery spray nozzles each coupled in fluid connection to the pressurized flow of cleaning fluid delivered through cleaning solution delivery tube 9. Spray nozzle arrays 132 deliver pressurized hot liquid solution of cleaning fluid to target carpeting or hard floor surface. Spray nozzle arrays 132 are distributed on rotary surface cleaning tool 124 in groups positioned between the plurality of suction extraction shoes 126. Accordingly, when rotary surface cleaning tool 124 turns at 150 RPM during operation, each spray nozzle array 132 delivers the pressurized hot liquid solution of cleaning fluid to the target floor surface at least one, two or more times each second. Consecutively with arrays 132 of spray nozzles, each of the plurality of suction extraction shoes 126 also covers the same area of the target floor as spray nozzle arrays 132 at least one, two or more times each second. Furthermore, each of the plurality of suction extraction shoes 126 includes a relatively narrow suction or vacuum extraction passage 136 oriented substantially radially of rotary surface cleaning tool 124.

Figure 8:
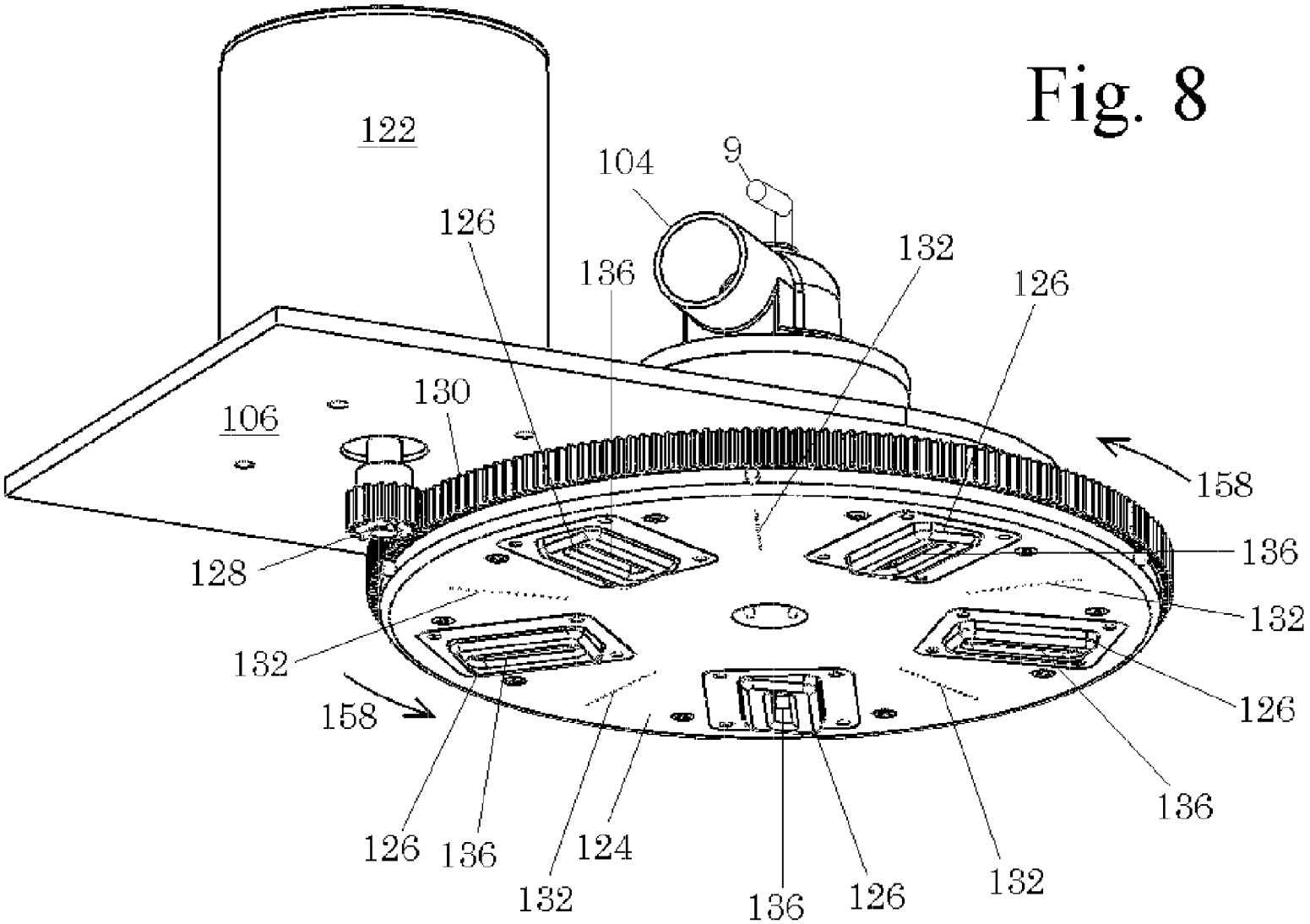
FIG. 8 illustrates the rotary surface cleaning tool of the rotary surface cleaning machine illustrated in FIG. 5 through FIG. 7, wherein the rotary surface cleaning tool is mounted on the support frame with an on-board power plant.

FIG. 8 illustrates the rotary surface cleaning tool 124 of the rotary surface cleaning machine 100 illustrated in FIGS. 5, 6 and 7, wherein rotary surface cleaning tool 124 is mounted on support frame 106 with on-board power plant 122. Here, by example and without limitation, rotary drive output 128 of on-board power plant 122 is a drive gear coupled to drive circumferential tooth gear 130 disposed about the circumference of rotary surface cleaning tool 124. However, as disclosed herein, drive means alternative to the rotary gear drive are also contemplated and may be substituted without deviating from the scope and intent of the present invention.

Figure 9:
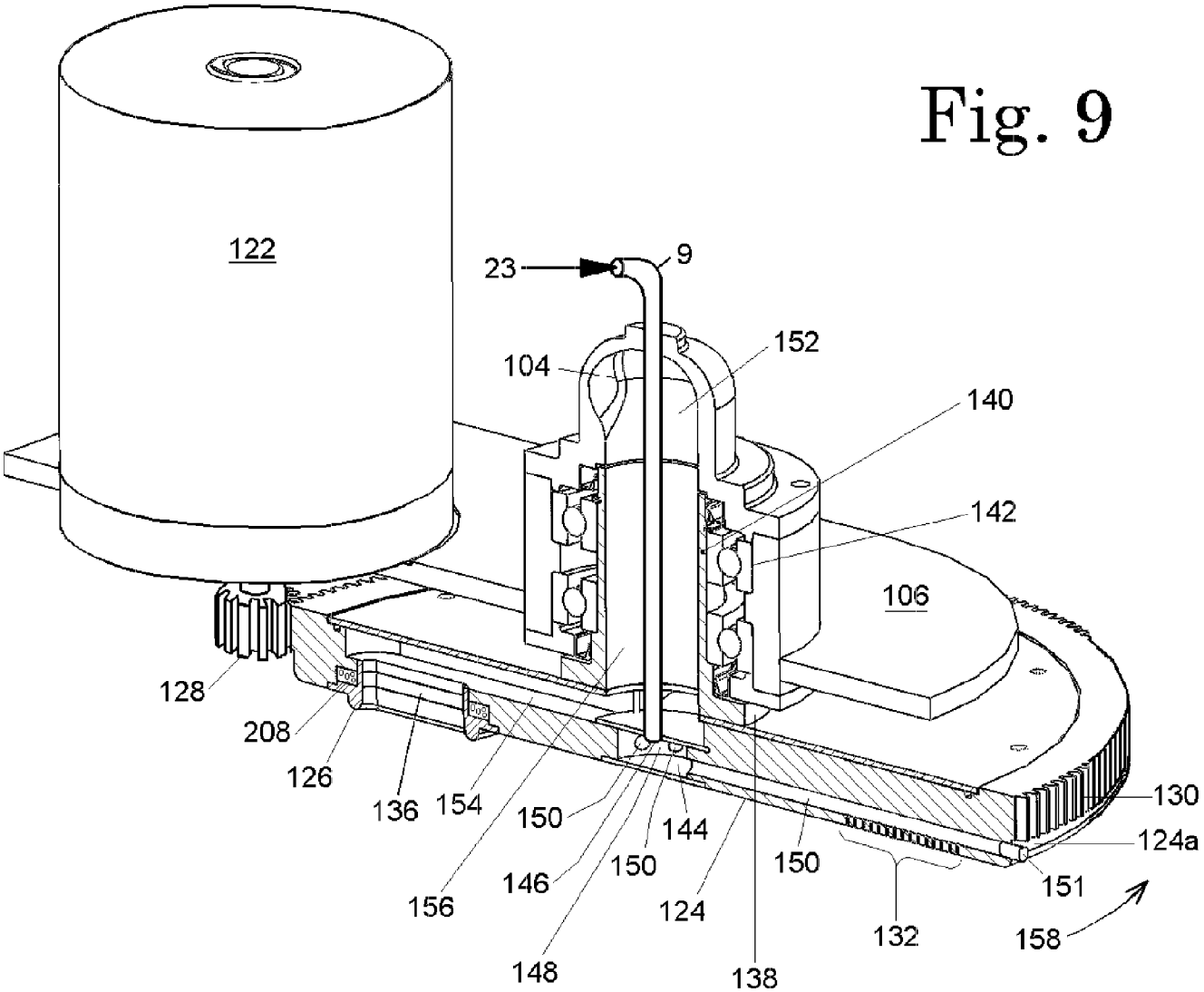
FIG. 9 is a partial cross-section view of the rotary surface cleaning machine illustrated in FIG. 5 through FIG. 8, wherein the rotary surface cleaning tool is mounted on the support frame through a rotary coupling.

FIG. 9 is a partial cross-section view of the rotary surface cleaning machine 100 illustrated in FIG. 5 through FIG. 8, wherein rotary surface cleaning tool 124 is mounted on support frame 106 through a rotary coupling. For example, rotary surface cleaning tool 124 is mounted through a cylindrical sleeve extension 138 of a rotor hub member 140 that is journaled in a bushing 142.

Each of the plurality of spray nozzle arrays 132 is coupled in fluid communication with the pressurized hot liquid solution of cleaning fluid through a cleaning fluid distribution manifold 144 that is in fluid communication with cleaning solution delivery tube 9. Cleaning fluid distribution manifold 144 includes a central sprue hole 146 for receiving the pressurized cleaning fluid and an expansion chamber 148 for reducing the pressure of the cleaning fluid to below a delivery pressure provided by the supply of pressurized cleaning solution, such as but not limited to supply 23 of pressurized cleaning solution in the cabinet 17 of a truck-mounted system, or another supply of pressurized cleaning solution. Expansion chamber 148 is connected for distributing the liquid cleaning fluid outward along a plurality of radial liquid cleaning fluid distribution channels 150 for delivery by the plurality of spray nozzle arrays 132 uniformly distributed across bottom cleaning surface 72 of rotary surface cleaning tool 124. Individual radial cleaning fluid distribution channels 150 are uniformly angularly distributed within rotary surface cleaning tool 124, wherein each of cleaning fluid distribution channels 150 communicates with one of the plurality of spray nozzle arrays 132 for delivery thereto of the pressurized hot liquid solution of cleaning fluid. Radial liquid cleaning fluid distribution channels 150 are optionally extended to an outer circumference 124*a* of the large rotor of surface cleaning tool 124 for ease of manufacturing, and later sealed with plugs 151.

Between adjacent arrays 132 of spray nozzles are distributed radially-oriented suction or vacuum extraction passage 136 each coupled to a vacuum source for retrieving a quantity of soiled cleaning fluid. Radially-oriented plurality of suction extraction shoes 126 are uniformly distributed angularly about rotary surface cleaning tool 124 for uniformly angularly distributing the suction or vacuum extraction passages 136 about rotary surface cleaning tool 124. Exhaust port 104 communicates with a vacuum plenum 152 within rotor hub member 140, which in turn communicates through respective suction extraction shoes 126 with each suction or vacuum extraction passage 136. For example, radially-oriented suction or vacuum extraction passages 136 communicate through individual vacuum plenum branch passages 154 that each communicate in turn with a central cylindrical passage 156 within rotor hub member 140. Central passage 156 communicates at its upper end through exhaust port 104 with exhaust pipe or hose 102.

As indicated by rotational arrow 158, rotary surface cleaning tool 124 is rotated at high speed during application of cleaning solution to the target surface. Rotary surface cleaning tool 124 successfully delivers a generally uniform distribution of liquid cleaning solution to a target surface, such as rug 57, between the quantity of arrays 132 of spray nozzles and the large number of passes, i.e. at least one, two or more passes per second, of each spray nozzle array 132 occasioned by the high rotational speed rotary surface cleaning tool 124 regardless of any lack of uniformity in the instantaneous fluid delivery of any individual spray nozzle array 132. Additionally, the instantaneous fluid delivery of each individual spray nozzles array 132 tends to be generally uniform at least because the length of the spray nozzle array 132 is minimal as compared with the size of rotary surface cleaning tool 124.

Figure 10:
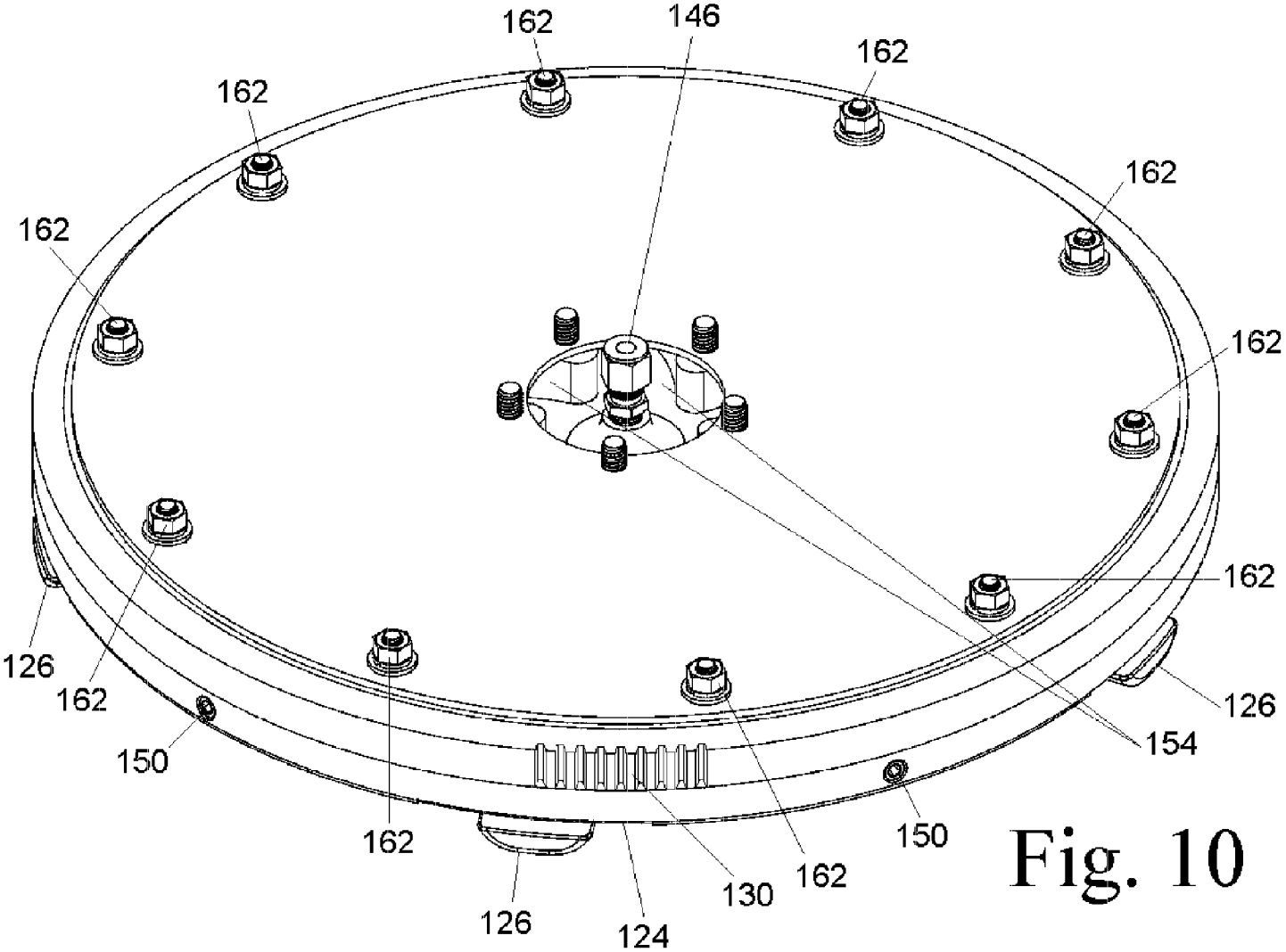
FIG. 10 illustrates the rotary surface cleaning tool of the rotary surface cleaning machine illustrated in FIG. 5 through FIG. 9, wherein the rotary surface cleaning tool is drivingly connected, for example but without limitation, by a drive gear to the rotary drive output of the on-board power plant.

FIG. 10 illustrates rotary surface cleaning tool 124 of the rotary surface cleaning machine 100 illustrated in FIG. 5 through FIG. 9, wherein rotary surface cleaning tool 124 is drivingly connected, for example but without limitation, by a drive gear to rotary drive output 128 of on-board power plant 122. Here, by example and without limitation, rotary surface cleaning tool 124 is a large rotor that is fixedly attached to a rotary drive member 160 through a fixed coupling 162, such as a plurality of threaded fasteners (shown) or other conventional fixed coupling means. Rotary drive member 160 includes circumferential tooth gear 130 disposed about the circumference thereof for operating as the drive gear coupled to rotary drive output 128 of on-board power plant 122.

Rotary drive member 160 is mounted to cylindrical sleeve extension 138 of rotor hub member 140 that is in turn journaled in bushing 142. See, for example, FIG. 9. The large rotor of rotary surface cleaning tool 124 is fitted with central sprue hole 146 and includes expansion chamber 148 and the plurality of individual closed liquid cleaning fluid distribution channels 150, as well as the plurality of spray nozzle arrays 132 that are uniformly distributed across the bottom cleaning surface of rotary surface cleaning tool 124. The large rotor of rotary surface cleaning tool 124 also includes individual vacuum plenum branch passages 154 that each communicate in turn with central cylindrical passage 156 of rotor hub member 140, as well as the plurality suction or vacuum extraction passages 136 of respective suction extraction shoes 126 located on rotary surface cleaning tool 124 and projected from open lower axial face 112 of circular housing 110.

Figure 11:
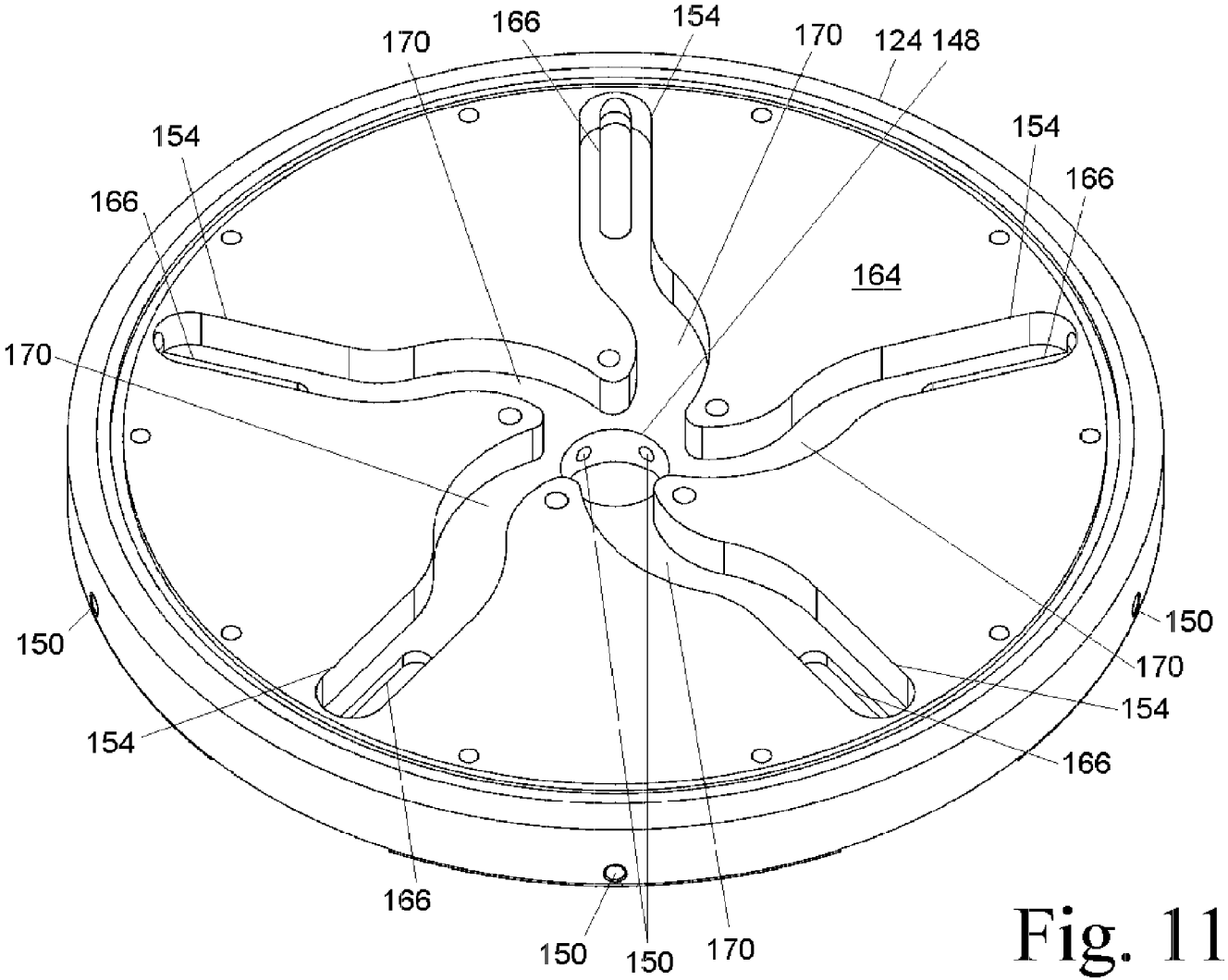
FIG. 11 illustrates an upper coupling surface of the rotary surface cleaning tool of the rotary surface cleaning machine illustrated in FIG. 5 through FIG. 9, as further illustrated in FIG. 10.

FIG. 11 illustrates an upper coupling surface 164 of rotary surface cleaning tool 124 of the rotary surface cleaning machine 100 illustrated in FIG. 5 through FIG. 9, as further illustrated in FIG. 10. The large rotor of rotary surface cleaning tool 124 is again illustrated as including expansion chamber 148 and the plurality of individual closed liquid cleaning fluid distribution channels 150 that communicate with the plurality of spray nozzle arrays 132 distributed across the bottom cleaning surface of rotary surface cleaning tool 124. Here, rotary drive member 160 is removed to more clearly show individual vacuum plenum branch passages 154 that each communicate in turn with central cylindrical passage 156 of rotor hub member 140. Each individual vacuum plenum branch passage 154 terminates in a fluid extraction passage 166 of about identical radial lengths 168 positioned adjacent to the circumference of the large rotor of rotary surface cleaning tool 124. In assembly, each shoe 126 is coupled to the lower face of rotary surface cleaning tool 124 with respective suction or vacuum extraction passages 136 in communication with a respective fluid extraction passage 166 of one of the individual vacuum plenum branch passages 154. As illustrated here by example and without limitation, individual vacuum plenum branch passages 154 optionally include a curved portion 170 inwardly of respective fluid extraction passage 166. Optional curved portion 170 of vacuum plenum branch passages 154, when present, operate to urge generation of a Coriolis effect in a suction or vacuum fluid extraction airstream received into central cylindrical passage 156 of rotor hub member 140.

Figure 12:
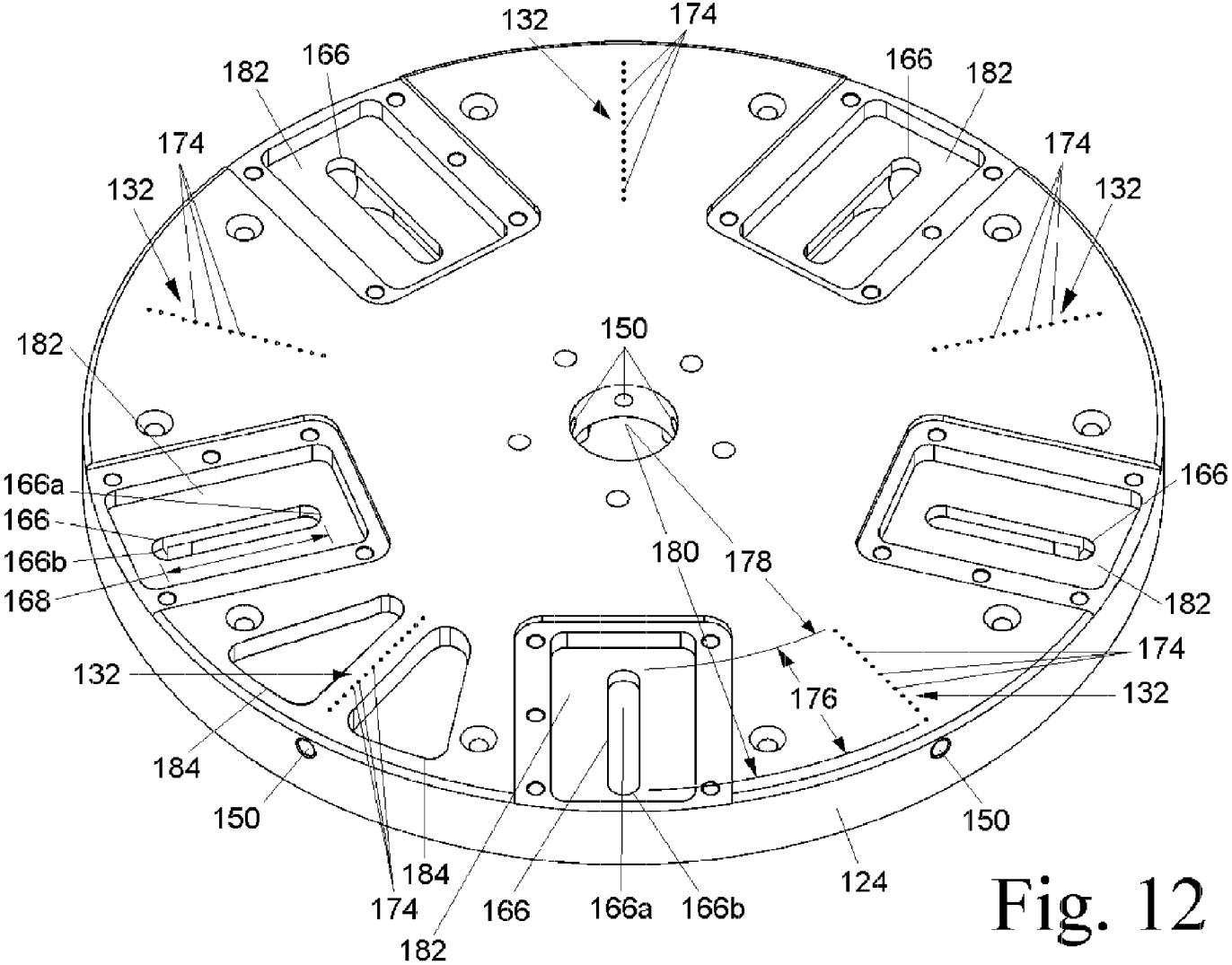
FIG. 12 illustrates a bottom operational surface of the rotary surface cleaning tool of the rotary surface cleaning machine illustrated in FIG. 5 through FIG. 9, as further illustrated in FIG. 10 and FIG. 11.

FIG. 12 illustrates a bottom operational surface 172 of rotary surface cleaning tool 124 of the rotary surface cleaning machine 100 illustrated in FIG. 5 through FIG. 9, as further illustrated in FIG. 10 and FIG. 11. The large rotor of rotary surface cleaning tool 124 is again illustrated as including expansion chamber 148 and the plurality of individual closed liquid cleaning fluid distribution channels 150 that communicate with the pluralities of spray nozzle arrays 132 distributed across the bottom operational surface 172 of rotary surface cleaning tool 124. Spray nozzle arrays 132 are illustrated here by example and without limitation as radially oriented arrays of pluralities of individual delivery spray nozzles 174 of about 1/10,000th of an inch in diameter formed through bottom operational surface 172 of rotary surface cleaning tool 124, for example by drilling, into communication with respective individual closed liquid cleaning fluid distribution channels 150 for delivery therethrough of the pressurized hot liquid solution of cleaning fluid. As illustrated here by example and without limitation, each spray nozzle array 132 consists of a plurality of individual delivery spray nozzles 174 substantially uniformly distributed over a substantially identical annular portion 176 of bottom operational surface 172 extended between an inner radial limit 178 and an outer radial limit 180 thereof, wherein annular portion 176 covered by delivery spray nozzles 174 has about the same radial extents as radial length 168 of fluid extraction passages 166 of suction extraction shoes 126, and wherein inner radial limit 178 is about identical with an inner terminus **166*a* of fluid extraction passages 166 and outer radial limit 180 is about identical with an outer terminus 166*b* of fluid extraction passages 166. Therefore, delivery spray nozzles 174 are distributed over annular portion 176 that is substantially radially coextensive with fluid extraction passages 166**.

Each individual fluid extraction passage 166 is positioned adjacent to the circumference of the large rotor of rotary surface cleaning tool 124 and oriented substantially radially thereof approximately halfway between adjacent cleaning solution delivery spray nozzle arrays 132. As illustrated here by example and without limitation, each individual fluid extraction passage 166 is positioned in a shoe recess 182 formed into rotary surface cleaning tool 124 below bottom operational surface 172 thereof. Each shoe recess 182 is appropriately sized and shaped to receive thereinto one suction extraction shoe 126 with its surrounding flange portion 184 being substantially flush with bottom operational surface 172 of rotary surface cleaning tool 124.

Optionally, a plurality of lightening holes or recesses 186 are provided to reduce the weight of rotary surface cleaning tool 124.

Figure 13:
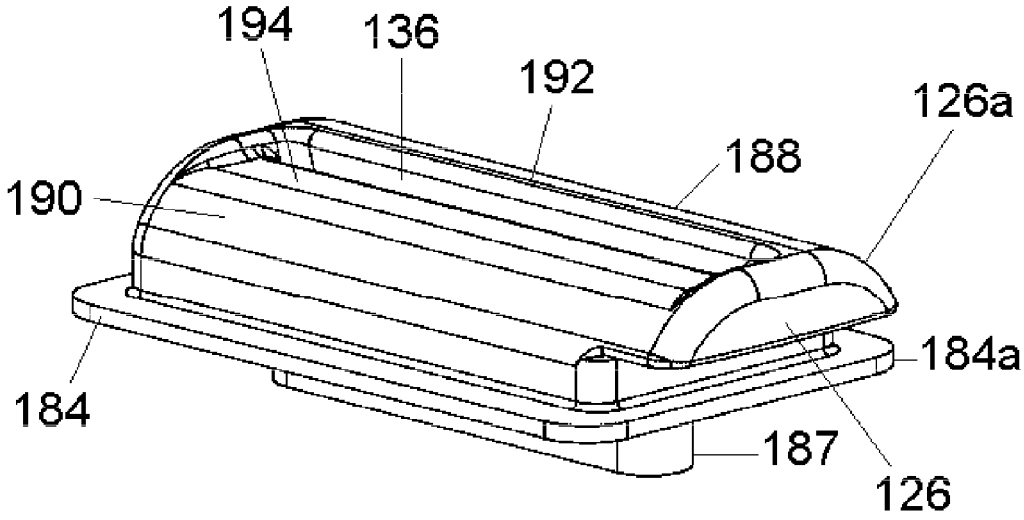
FIG. 13 is a detail view of one embodiment of the suction extraction shoe of the rotary surface cleaning machine illustrated in FIG. 5 through FIG. 9.

FIG. 13 is a detail view of one embodiment of suction extraction shoe 126 of the rotary surface cleaning machine 100 illustrated in FIG. 5 through FIG. 9. As disclosed herein above, suction extraction shoe 126 is structured to sit in recess 182 flush or below bottom operational surface 172 of rotary surface cleaning tool 124. Accordingly, flange portion 184 surrounding each suction extraction shoe 126 is structured for being fixed to bottom operational surface 172 of rotary surface cleaning tool 124 within shoe recess 182. Optionally, suction extraction shoe 126 may include a sealing member 187 structured to fit into preformed slots in bottom operational surface 172 of rotary surface cleaning tool 124 and form a substantially airtight seal therewith to concentrate the force of the fluid extraction suction generated by the vacuum force supplied by vacuum source 25 into individual fluid extraction passages 136 of shoes 126.

Figure 15:
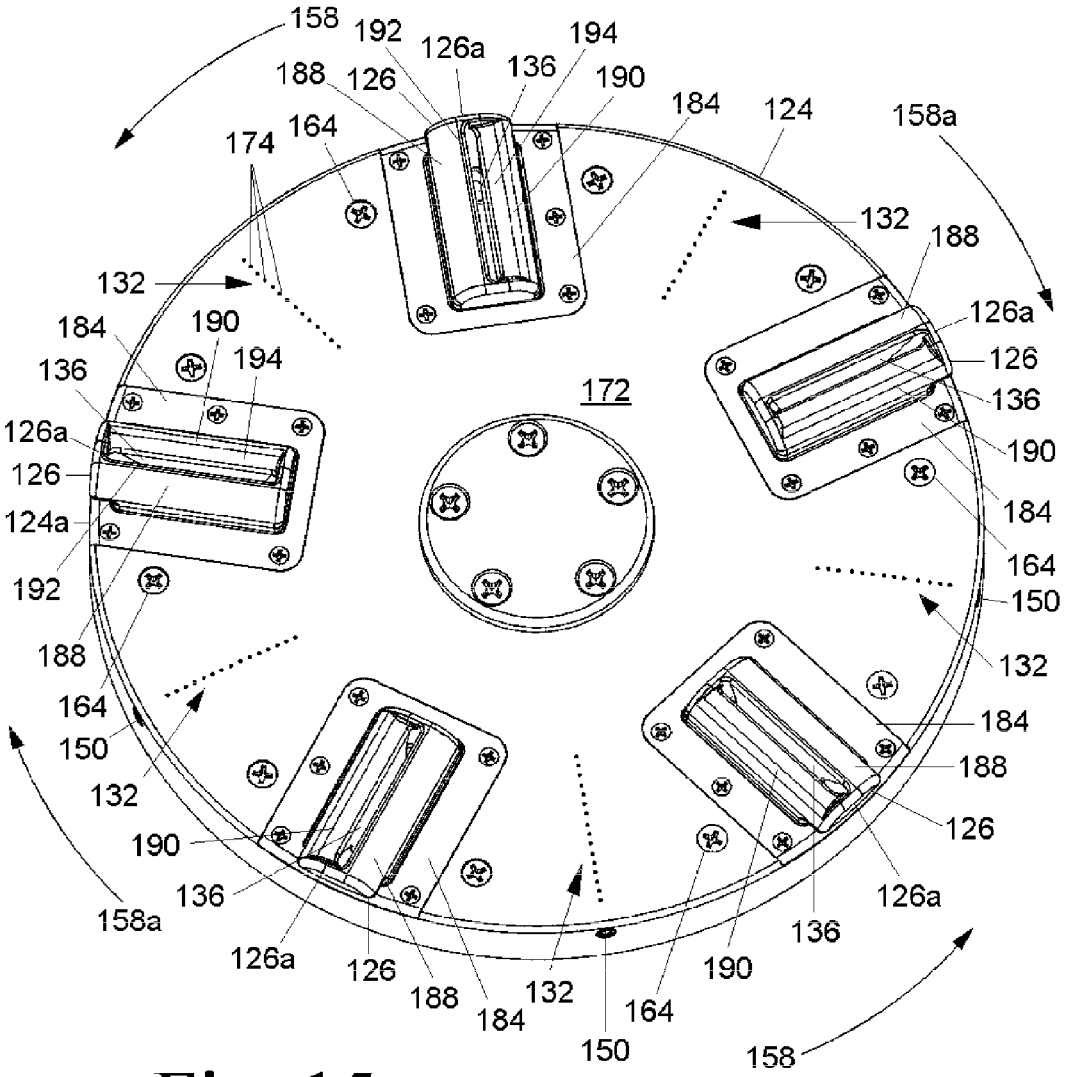
FIG. 15 illustrates the bottom operational surface of the rotary surface cleaning tool of the rotary surface cleaning machine illustrated in FIG. 5 through FIG. 9, having the suction extraction shoe with an optional raised leading surface portion and a relatively lower trailing surface portion as illustrated in FIG. 13 and FIG. 14.

Here, suction extraction shoe 126 is shown as having a leading surface 188 and a trailing surface 190 as a function of the rotational direction (arrow 158) of rotary surface cleaning tool 124. As shown here, leading surface 188 is shown by example and without limitation as having an optional relatively raised portion 192 thereof that stands out further from bottom operational surface 172 of rotary surface cleaning tool 124 than a relatively lower or recessed portion 194 of trailing surface 190. When optional raised portion 192 of suction extraction shoe 126 is present, optional raised portion 192 of suction extraction shoe 126 causes a "washboard" scrubbing effect of a moveable target surface, i.e. carpet surface, wherein up-down oscillations of the moveable carpet are caused by alternate application of vacuum suction and shoe compression of carpet 57. In other words, the target carpet is initially sucked up toward recessed trailing portion 194 of shoe 126 and operational surface 172 by one suction extraction passage 136, and then squeezed back down by optional raised portion 192 of leading surface 188 of a next consecutive suction extraction shoe 126, as illustrated in FIG. 15, before being immediately sucked up again by the suction extraction passage 136 of the same next consecutive suction extraction shoe 126. This alternate vacuum suction and shoe compression of carpet 57 is repeated by each next consecutive suction extraction shoe 126 as a function of the combination of recessed trailing portion 194 and raised leading surface portion 192. Since rotary surface cleaning tool 124 turns at a high speed rotary motion these up-down oscillations of the moveable carpet are repeated at least one, two or several times each second, which results in significantly aggressive agitation of the target carpet 57 in combination with the fluid cleaning.

Alternatively, rotational direction (arrow 158) of rotary surface cleaning tool 124 is reversed, whereby optional raised portion 192 is positioned on trailing surface 190 as a function of the reversed rotational direction (arrow 158*a* shown in FIG. 15). Accordingly, the "washboard" scrubbing effect of the moveable target surface, i.e. carpet surface, is accomplished by the recessed leading surface 188 and optional raised portion 192 of each suction extraction shoe 126 in turn. Furthermore, as illustrated here each suction extraction shoe 126 optionally further includes an extension portion 126*a* that overhangs an outer end portion 184*a* of its surrounding flange portion 184. Extension portion 126*a* permits extraction passages 136 to extend radially outwardly of cleaning tool operational surface 172 beyond the radial extent of fluid extraction passages 166 of rotary surface cleaning tool 124. Accordingly, when optional extension portion 126*a* is present, suction extraction passages 136 extend nearly to outer circumference 124*a* of the large rotor of surface cleaning tool 124, as illustrated in FIG. 15.

Figure 14:
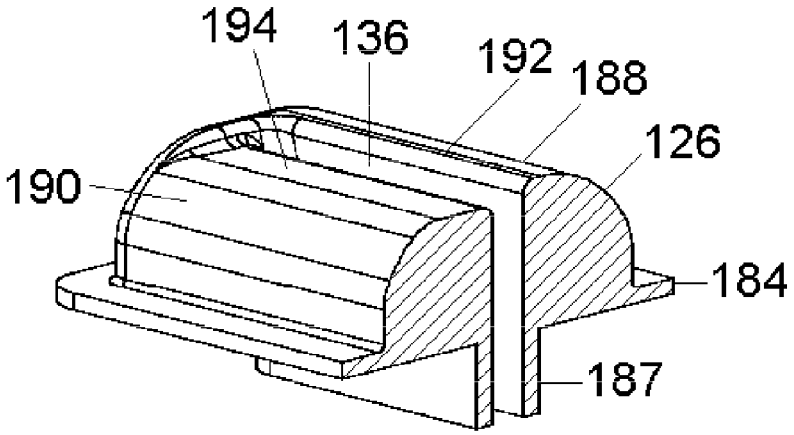
FIG. 14 is a detailed cross-section view of one embodiment of the suction extraction shoe illustrated in FIG. 13, wherein the suction extraction shoe is shown as having a leading surface and a trailing surface as a function of the rotational direction of the rotary surface cleaning tool.

FIG. 14 is a detailed cross-section view of one embodiment of suction extraction shoe 126 illustrated in FIG. 13, wherein suction extraction shoe 126 is shown as having leading surface 188 and trailing surface 190 as a function of the rotational direction (arrow 158) of rotary surface cleaning tool 124. As shown here, leading surface 188 is shown by example and without limitation as having optional raised portion 192 thereof that stands out further from bottom operational surface 172 of rotary surface cleaning tool 124 than relatively lower or recessed portion 194 of trailing surface 190.

FIG. 15 illustrates bottom operational surface 172 of rotary surface cleaning tool 124 of the rotary surface cleaning machine 100 illustrated in FIG. 5 through FIG. 9, having suction extraction shoe 126 with optional raised surface portion 192 formed on leading surface 188 and relatively lower or recessed surface portion 194 formed on trailing surface 190 as illustrated in FIG. 13 and FIG. 14. Here, suction extraction shoe 126 is illustrated having optional raised surface portion 192 leading and relatively lower or recessed surface portion 194 trailing as a function of the optional counterclockwise rotational direction (arrow 158) of rotary surface cleaning tool 124. It will be understood that suction extraction shoes 126 and rotational direction 158 of rotary surface cleaning tool 124 is optional and can be reversed such that the functional leading surface 188 and functional trailing surface 190 portions thereof are maintained. Accordingly, reversal of rotational directionality 158 of rotary surface cleaning tool 124 disclosed herein by example and without limitation is also contemplated and may be substituted without deviating from the scope and intent of the present invention. Suction extraction shoe 126 are attached to bottom operational surface 172 of rotary surface cleaning tool 124 by attachment means 196, such as but not limited to one or more threaded fasteners.

Figure 16:
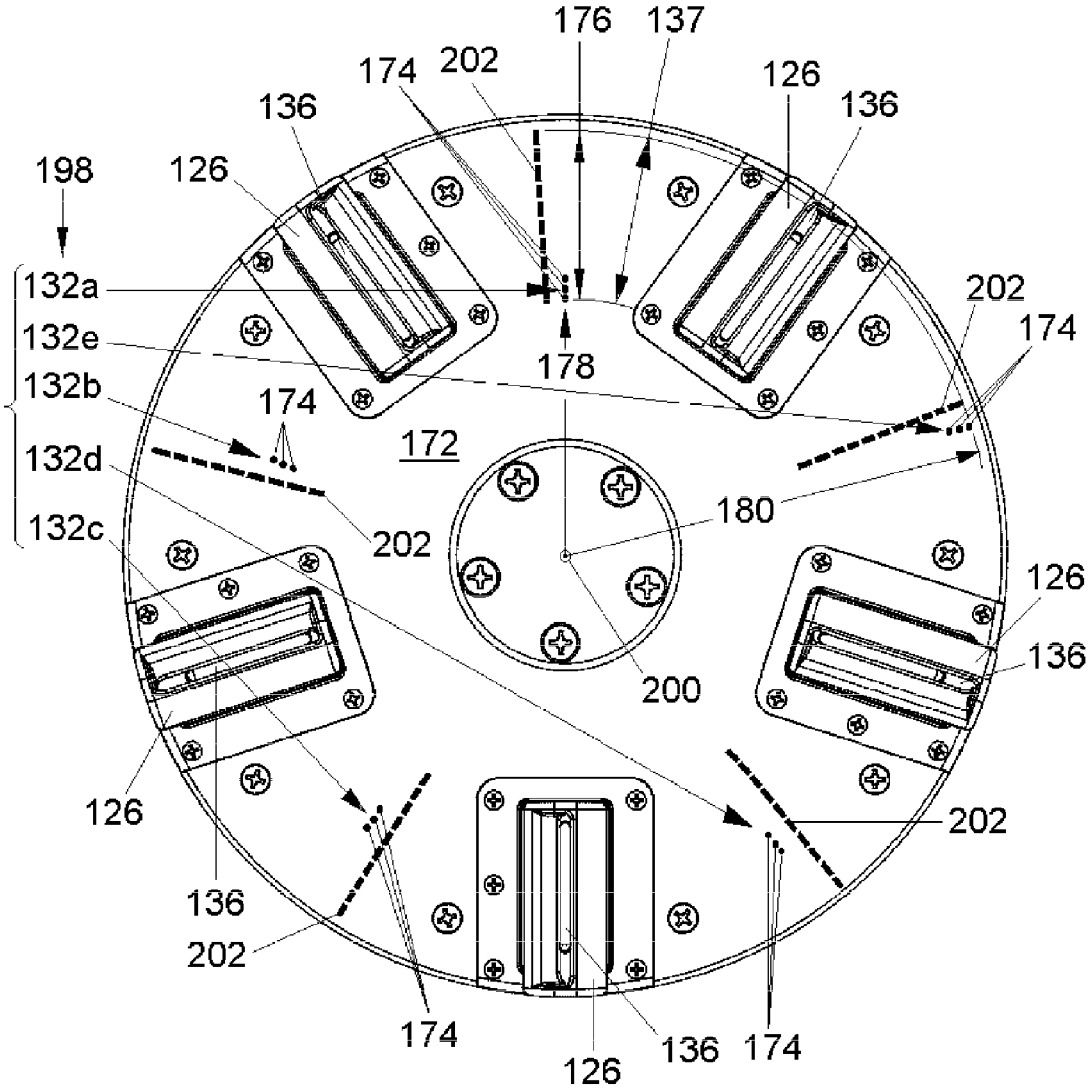
FIG. 16 illustrates bottom the operational surface of the rotary surface cleaning tool of the rotary surface cleaning machine illustrated in FIG. 5 through FIG. 9, having a spiral pattern of cleaning solution delivery spray nozzle arrays of individual delivery holes, wherein each spray nozzle array consists of one to about four individual delivery holes, and wherein the individual spray nozzle arrays are positioned in a spiral pattern across the bottom operational surface of the rotary surface cleaning tool.

FIG. 16 illustrates bottom operational surface 172 of rotary surface cleaning tool 124 of the rotary surface cleaning machine 100 illustrated in FIG. 5 through FIG. 9, having a spiral pattern of cleaning solution delivery spray nozzle arrays 132 of individual delivery spray nozzles 174, wherein each spray nozzle array 132*a*, 132*b*, 132*c*, 132*d* and 132*e* consists of one to about four individual delivery spray nozzles 174, and wherein individual spray nozzle arrays 132*a*, 132*b*, 132*c*, 132*d*, 132*e* are positioned in a spiral pattern 198 across bottom operational surface 172 of rotary surface cleaning tool 124 that is substantially radially coextensive with radial lengths 137 of fluid extraction passages 136 of shoes 126 between the extremes of annular portion 176 between inner radial limit 178 and outer radial limit 180. The spiral pattern 198 of spray nozzle array 132*a*, 132*b*, 132*c*, 132*d*, 132*e* optionally proceeds in a uniform stepwise manner around bottom operational surface 172 of rotary surface cleaning tool 124, with nozzle array 132*a* being nearest to a center point 200 of operational surface 172 and substantially radially coextensive with inner radial limit 178 and each consecutive nozzle array 132*a*, 132*b*, 132*c*, 132*d*, 132*e* stepping further outwardly therefrom toward outer radial limit 180 of operational surface 172. Alternatively, the stepwise manner of spiral pattern 198 of spray nozzle arrays 132*a*, 132*b*, 132*c*, 132*d*, 132*e* alternatively proceeds in a non-uniform manner (shown) wherein one or more of spray nozzle arrays 132*a*, 132*b*, 132*c*, 132*d*, 132*e* is optionally out of step with an adjacent one of spray nozzle arrays 132*a*, 132*b*, 132*c*, 132*d*, 132*e*. Thus, spiral pattern 198 of spray nozzle arrays 132*a*, 132*b*, 132*c*, 132*d*, 132*e* is optionally either uniformly stepwise between inner radial limit 178 and outer radial limit 180 of radial lengths 168 of fluid extraction passages 136 of shoes 126, else spiral pattern 198 proceeds in a non-uniform manner. Spiral pattern 198 of spray nozzle arrays 132*a*, 132*b*, 132*c*, 132*d*, 132*e* proceeds in either a clockwise manner between inner radial limit 178 and outer radial limit 180 of radial lengths 137 of fluid extraction passages 136 of shoes 126, else spiral pattern 198 proceeds in a counterclockwise manner without departing from the spirit and scope of the invention.

The spiral pattern 198 of spray nozzle arrays 132*a*, 132*b*, 132*c*, 132*d*, 132*e* is effective for delivery of cleaning solution at least because, as disclosed herein, rotary surface cleaning tool 124 turns at a high rate during operation, whereby each spray nozzle array 132*a*, 132*b*, 132*c*, 132*d*, 132*e* delivers the pressurized hot liquid solution of cleaning fluid to the target floor surface at least one, two or more times each second. Furthermore, dividing spray nozzle arrays 132 into several spray nozzle arrays 132*a*, 132*b*, 132*c*, 132*d*, 132*e* reduces the number of individual delivery spray nozzles 174 that have to be drilled or otherwise formed through bottom operational surface 172 of rotary surface cleaning tool 124 by a factor of the number of spray nozzle arrays 132 otherwise provided in rotary surface cleaning tool 124. Here, as illustrated in FIG. 12, there are five radial rows of spray nozzle arrays 132 across operational surface 172. By dividing spray nozzle arrays 132 into several spray nozzle arrays 132*a*, 132*b*, 132*c*, 132*d*, 132*e*, the total number of individual delivery spray nozzles 174 that have to be provided in bottom operational surface 172 is reduced by a factor of five, so that only one-fifth or twenty percent of the number of delivery spray nozzles 174 that have to be provided in bottom operational surface 172. Delivery spray nozzles 174 are very expensive to drill or otherwise form because they are only about 1/10,000th of an inch in diameter. Therefore, a large cost savings is gained, while the delivery of cleaning solution does not suffer. A further advantage of dividing spray nozzle arrays 132 into several spray nozzle arrays 132*a*, 132*b*, 132*c*, 132*d*, 132*e* is that the cleaning solution is delivered with substantially uniform pressure across the entire radius of rotary surface cleaning tool 124 between inner radial limit 178 and outer radial limit 180, without resorting to special design features normally required in the prior art to provide uniform pressure across each spray nozzle arrays 132 that extends all of the entire annular portion 176 between inner radial limit 178 and outer radial limit 180 and substantially radially coextensively with fluid extraction passages 136 of suction extraction shoes 126. Therefore, the optional spiral pattern 198 of spray nozzle arrays 132*a*, 132*b*, 132*c*, 132*d*, 132*e*, when present, provides both the economic advantage not known in the prior art of forming fewer expensive delivery spray nozzles 174 for multiple spray nozzle arrays 132 provide across the entire length of annular portion 176 coextensively with fluid extraction passages 136 of shoes 126, and the technological advantage not known in the prior art of providing substantially uniform cleaning solution delivery pressure across bottom operational surface 172 of rotary surface cleaning tool 124 for the entire length of annular portion 176 without developing special fluid delivery features normally required in the prior art.

Optionally, one or more bristle brushes 202 may be provided across bottom operational surface 172 of rotary surface cleaning tool 124 adjacent to cleaning solution delivery spray nozzle arrays 132, or the optional spiral pattern 198 of spray nozzle arrays 132*a*, 132*b*, 132*c*, 132*d*, 132*e*, when present. Bristle brushes 202 may be provided substantially radially coextensively with fluid extraction passages 136 of suction extraction shoes 126 and either adjacent cleaning solution delivery spray nozzle arrays 132, or the optional spiral pattern 198 of spray nozzle arrays 132*a*, 132*b*, 132*c*, 132*d*, 132*e*, when present. Optionally, either multiple radial rows bristle brushes 202 may be provided, else single radial rows of bristle brushes 202 may be provided. Bristle brushes 202 both (1) separate fibers of rug 57 for dry removal of dust, dirt and other particles, and (2) provide a more aggressive cleaning action in cleaning when provided in combination with fluid cleaning of carpet or other target flooring surface.

Figure 17:
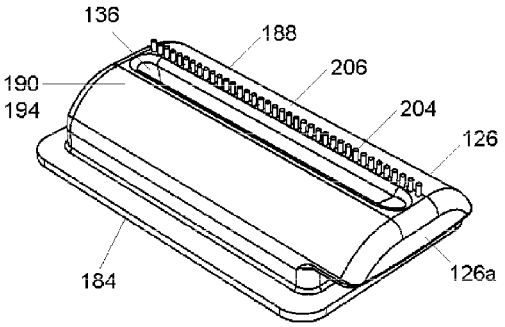
FIG. 17 is a detail view of another embodiment of the suction extraction shoe of the rotary surface cleaning machine illustrated in FIG. 5 through FIG. 9, wherein the leading surface does not include the optional raised portion but is rather substantially coplanar with the trailing surface, but the leading surface rather includes one or more bristle brushes in one or more rows arranged along an outermost portion thereof.
Figure 18:
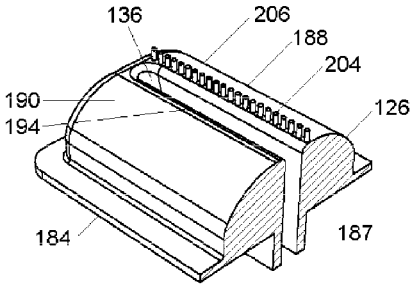
FIG. 18 is a detailed cross-section view of the embodiment of the suction extraction shoe illustrated in FIG. 17.

FIG. 17 is a detail view of another embodiment of suction extraction shoe 126 of the rotary surface cleaning machine 100 illustrated in FIG. 5 through FIG. 9, and FIG. 18 is a detailed cross-section view of the embodiment of suction extraction shoe 126 illustrated in FIG. 17. Here, leading surface 188 does not include the optional raised portion 192. Therefore, leading surface 188 of suction extraction shoe 126 is substantially coplanar with trailing surface 190. However, leading surface 188 rather includes one or more bristle brushes 204 in one or more rows arranged along an outermost portion 206 thereof. Accordingly, bristle brushes 204 are substituted for optional raised portion 192 of shoe leading surface 188 and stands out further from bottom operational surface 172 of rotary surface cleaning tool 124 than relatively lower or recessed portion 194 of trailing surface 190. Raised bristle brushes 204 of shoe leading surface 188 operate similarly to optional raised portion 192 disclosed herein. When optional raised bristle brushes 204 of suction extraction shoe 126 is present on shoe leading surface 188, optional raised bristle brushes 204 cause a "washboard" scrubbing effect of the moveable target surface, i.e. carpet surface, wherein up-down oscillations of the moveable carpet is caused by alternately application of vacuum suction and shoe compression of carpet. In other words, the target carpet is sucked up into narrow suction or vacuum extraction passage 136, and then squeezed back down by optional raised bristle brushes 204 of leading surface 188 of next consecutive suction extraction shoe 126, as illustrated in FIG. 15.

Similarly to optional bristle brushes 202 on bottom operational surface 172 of rotary surface cleaning tool 124, optional raised bristle brushes 204 on leading surfaces 188 of suction extraction shoes 126 provide a more aggressive cleaning action in cleaning when provided in combination with fluid cleaning of carpet or other target flooring surface.

Furthermore, when present optional raised bristle brushes 204 effectively raise bottom operational surface 172 of rotary surface cleaning tool 124 slightly away from target floor surface. Accordingly, rotary surface cleaning tool 124 can be alternated between carpeting and hard floor surfaces such as wood, tile, linoleum and natural stone flooring, without possibility of scarring or other damage to either operational surface 172 of rotary surface cleaning tool 124 or the hard floor surfaces.

Figure 19:
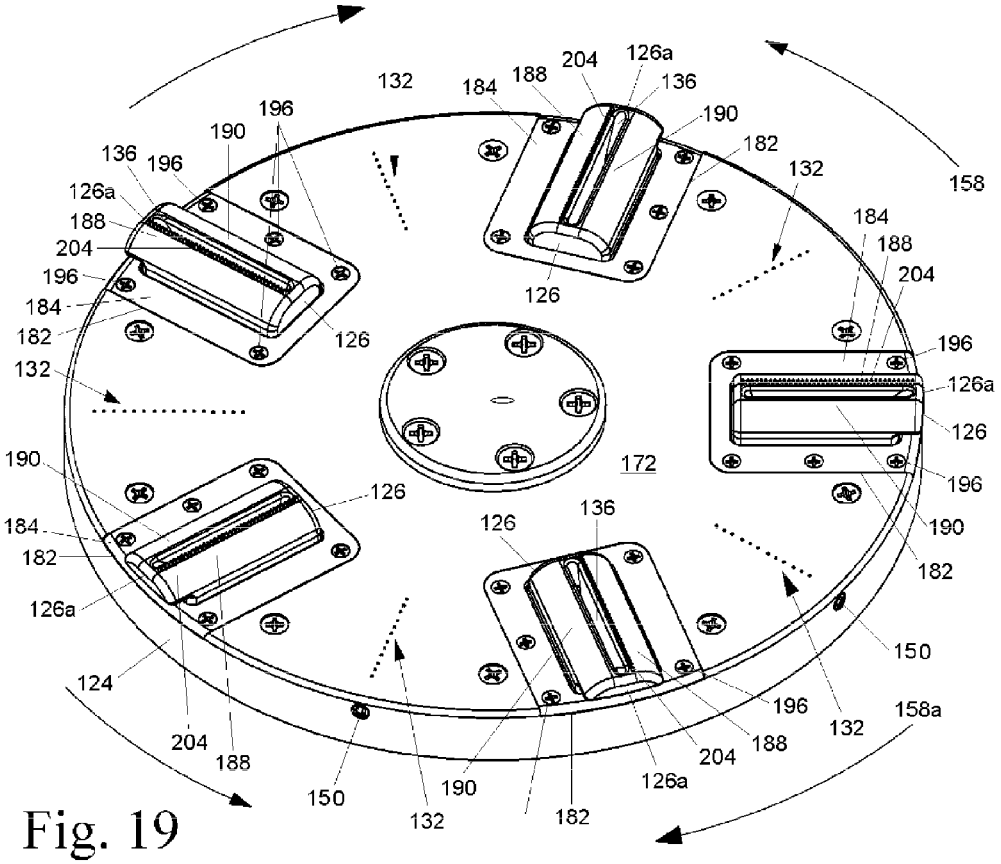
FIG. 19 illustrates the operational surface of the rotary surface cleaning tool of the rotary surface cleaning machine illustrated in FIG. 5 through FIG. 9, wherein the suction extraction shoes are configured with substantially coplanar leading and trailing surfaces, and the shoe leading surfaces have one or more of the bristle brushes in one or more rows arranged along the outermost portions thereof.

FIG. 19 illustrates operational surface 172 of rotary surface cleaning tool 124, wherein suction extraction shoes 126 are configured with substantially coplanar leading and trailing surfaces 188, 190 and shoe leading surfaces 188 are configured with one or more bristle brushes 204 in one or more rows arranged along outermost portions 206 thereof.

Figure 20:
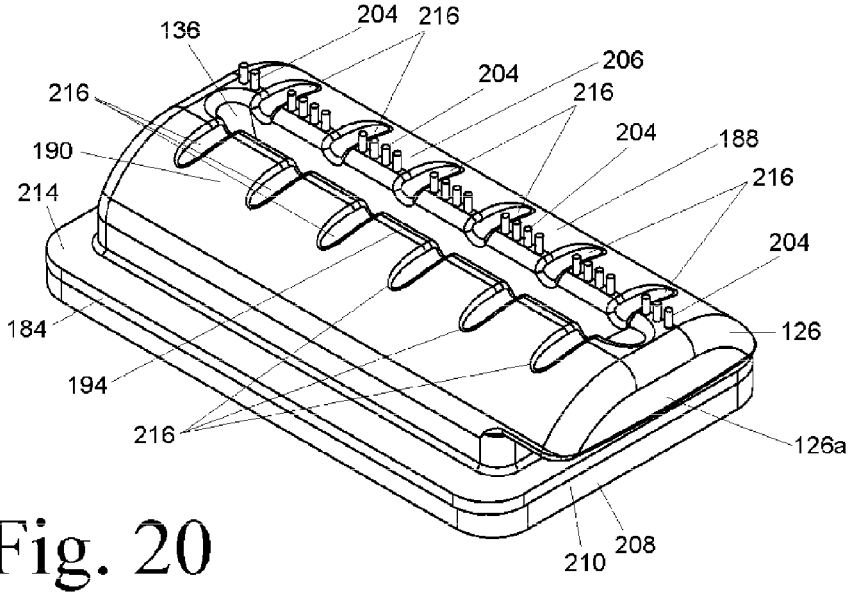
FIG. 20 illustrates rotary surface cleaning tool of the rotary surface cleaning machine illustrated in FIG. 5 through FIG. 9, wherein each suction extraction shoe is supported in the bottom operational surface by a biasing means structured for individually biasing or "floating" each suction extraction shoe outwardly relative to the bottom operational surface of the rotary surface cleaning tool.

FIG. 20 illustrates rotary surface cleaning tool 124 as disclosed herein, wherein each suction extraction shoe 126 is supported in bottom operational surface 172 by a biasing means 208 structured for individually biasing each suction extraction shoe 126 outwardly relative to bottom operational surface 172 of rotary surface cleaning tool 124.

Additionally, it is generally well known that if a suction slot directly contacts rug 57 or another floor, the suction tool virtually locks onto the rug 57 or floor and becomes immovable. Therefore, the suction tool must be spaced away from the rug 57 or floor to permit some airflow which prevents such vacuum lock-up. Airflow is also necessary for drying the carpet 57 or floor. However, the airflow must be very near the rug 57 or floor to be effective for drying. Also, excessive airflow decreases the vacuum force supplied by the fluid cleaning system. Thus, there is a trade-off between distancing the suction slot from the rug 57 or floor to prevent vacuum lock-up and ensuring mobility on the one hand, and on the other hand positioning the suction slot as near to the rug 57 or floor as possible for maintaining the vacuum force supplied by the fluid cleaning system for maximizing airflow to promote drying.

As disclosed herein, suction extraction passages 136 are oriented substantially perpendicular to the counterclockwise or clockwise rotary motion (arrows 158, 158*a*) of cleaning tool 124, i.e., oriented substantially radially with respect to cleaning tool operational surface 172. Here, suction extraction shoe 126 includes a plurality of shallow vacuum or suction relief grooves 216 formed across its leading surface 188 and oriented substantially perpendicular to suction extraction passages 136, whereby suction relief grooves 216 lie substantially along the rotary motion (arrows 158, 158*a*) of cleaning tool 124. Shallow suction relief grooves 216 operate to increase airflow to suction extraction passages 136, while permitting the cleaning tool operational surface 172 to be positioned directly against the rug 57 or floor, whereby moisture extraction is maximized. Another advantage of orienting suction relief grooves 216 along the rotary motion (arrows 158, 158*a*) of cleaning tool 124 is that suction relief grooves 216 are carpet pile enters into suction relief grooves 216 when cleaning tool operational surface 172 moves across rug 57. This permits airflow to be pulled through the rug 57 between fiber bundles that make up the carpet pile so that the rotary motion of cleaning tool 124 is not wasted.

The quantity and actual dimensions of suction relief grooves 216 on suction extraction shoes 126 is subject to several factors, including but not limited to, the size and number of suction extraction shoes 126 on operational surface 172 of rotary cleaning tool 124, width and length dimensions of suction extraction passages 136, and the vacuum force generated by the suction source, as well as the rotational velocity of cleaning tool operational surface 172. When relatively raised portion 192 is present in contrast to relatively lower or recessed portion 194, the resulting height differences between leading surface 188 and trailing surface 190 also affect the quantity and actual dimensions of suction relief grooves 216 on suction extraction shoes 126. Optionally, suction relief grooves 216 are also optionally positioned on either one or both of leading surface 188 and trailing surface 190 of suction extraction shoes 126. When positioned on both leading surface 188 and trailing surface 190 of suction extraction shoes 126, suction relief grooves 216 are also optionally staggered between leading and trailing surfaces 188, 190 as shown. Furthermore, the inventors have found that, when optional suction relief grooves 216 of suction extraction shoe 126 are present, optional suction relief grooves 216 of suction extraction shoe 126 is effective for producing the completely unexpected and unpredictable yet desirable result of generating the "washboard" scrubbing effect of a moveable target surface, i.e. carpet surface, wherein up-down oscillations of the moveable carpet are caused by alternate application of vacuum suction and shoe compression of carpet 57. In other words, the target carpet is initially sucked up toward recessed suction relief grooves 216 of shoe 126 and operational surface 172 by one suction extraction passage 136, and then squeezed back down by surrounding leading or trailing surfaces 188, 190 of suction extraction shoe 126, before being immediately sucked up again by the suction extraction passage 136 of the same or an adjacent suction relief grooves 216. This alternating vacuum suction and shoe compression of carpet 57 is repeated constantly by each alternate encounter with surrounding leading or trailing surfaces 188, 190 of suction extraction shoe 126 between encounters with adjacent suction relief grooves 216 as a function of the frequency of combination of recessed suction relief grooves 216 within surrounding leading or trailing surfaces 188, 190. The high speed rotary motion of rotary surface cleaning tool 124 causes these up-down oscillations of the moveable carpet are repeated at least one, two or several times each second, which results in significantly aggressive agitation of the target carpet 57 in combination with the fluid cleaning. The size, quantity, relative positioning and distribution and of suction relief grooves 216 is a function of all these factors, but can be determined for any rotary surface cleaning machine 100 without undue experimentation.

Figure 21:
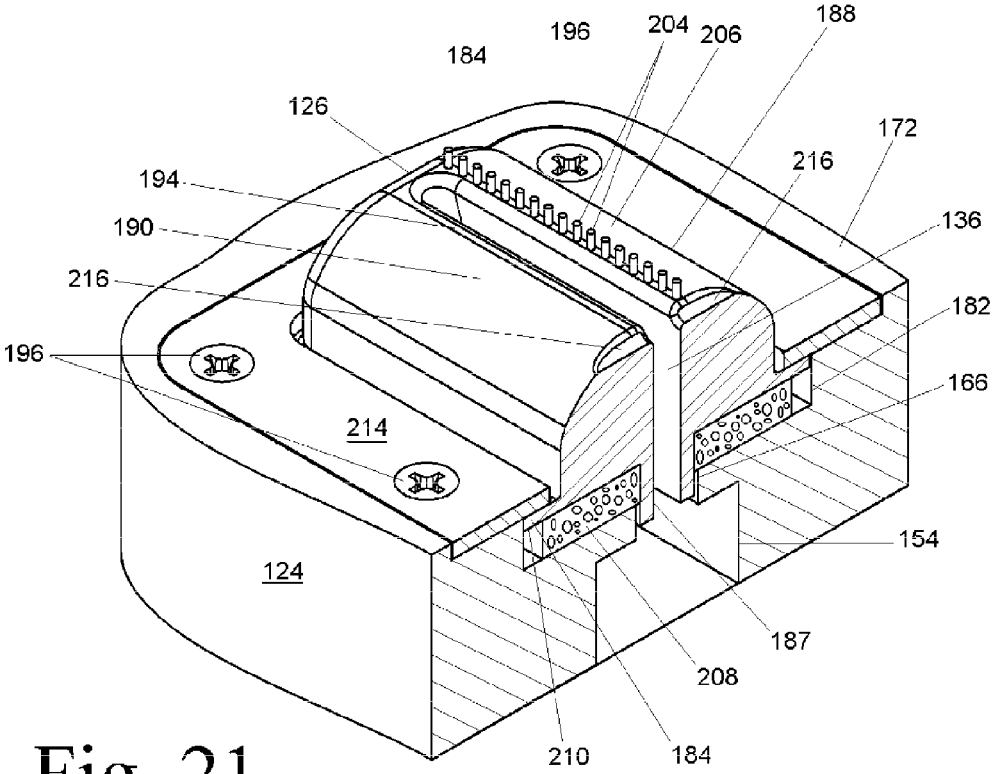
FIG. 21 is a cross-section view of the rotary surface cleaning tool of the rotary surface cleaning machine illustrated in FIG. 5 through FIG. 9, wherein the biasing means for individually biasing or "floating" each suction extraction shoe outwardly relative to the bottom operational surface of the rotary surface cleaning tool is structured, by example and without limitation, as a resilient cushion, such as a closed foam rubber cushion of about one-quarter inch thickness or thereabout, that is positioned between a flange portion of each shoe and the rotary surface cleaning tool.

FIG. 21 is a cross-section view of rotary surface cleaning tool 124 as disclosed herein, wherein both leading surface 188 and trailing surface 190 of suction extraction shoes 126 are illustrated as including suction relief grooves 216.

Here, biasing means 208 is structured by example and without limitation as a resilient cushion, such as a closed-cell foam rubber cushion of about one-quarter inch thickness or thereabout, that is positioned between flange portion 184 of each shoe 126 and rotary surface cleaning tool 124. For example, each shoe recess 182 is recessed deeper into bottom operational surface 172 of rotary surface cleaning tool 124 than a thickness of shoe flange portion 184, whereby each shoe recess 182 is appropriately sized to receive resilient biasing cushion 208 between an interface surface 210 of flange portion 184 of suction extraction shoe 126 and a floor portion 212 of shoe recess 182, while a clamping plate 214 is positioned over shoe flange 184 and arranged substantially flush with bottom operational surface 172 of rotary surface cleaning tool 124. Accordingly, resilient biasing means 208 permits each suction extraction shoe 126 to "float" individually relative to rotary surface cleaning tool 124. Individually "floating" each suction extraction shoe 126 both effectively balances rotary surface cleaning tool 124, and causes each individual suction extraction shoe 126 to be pushed deeper into portions of carpet that may be positioned over small recesses in a non-flat substrate floor surface, as well as pushing causes each individual suction extraction shoe 126 deeper into portions of a non-flat smooth floor surface such as natural rock, distressed wood, and other non-flat or pitted floor surfaces. Therefore, individually "floating" each suction extraction shoe 126 in bottom operational surface 172 of rotary surface cleaning tool 124 cleans carpet and non-carpeted smooth floors alike more effectively than cleaning tools having fixed suction extraction shoes, as known in the prior art.

When present as a closed foam cushion, biasing means 208 optionally also operates as a sealing means between suction extraction shoe 126 and rotary surface cleaning tool 124. Accordingly, biasing means 208 is structured to form a substantially airtight seal with shoe recess 182 in bottom operational surface 172 of rotary surface cleaning tool 124 to concentrate the force of the fluid extraction suction generated by the vacuum force supplied by vacuum source 25 into individual fluid extraction passages 136 of shoes 126. Optionally, closed foam cushion biasing means 208 is substituted for sealing member 187 for sealing suction extraction shoe 126 relative to rotary surface cleaning tool 124. However, although disclosed herein by example and without limitation as a closed foam rubber cushion, biasing means 208 is optionally provided as any resilient biasing structure, including one spring or a series of springs, without deviating from the scope and intent of the present invention. Accordingly, biasing means alternative to the closed foam rubber cushion biasing means 208 disclosed herein by example and without limitation are also contemplated and may be substituted without deviating from the scope and intent of the present invention.

FIG. 22 is a detail view of another embodiment of suction extraction shoe 126 of the rotary surface cleaning machine 100 illustrated in FIG. 5 through FIG. 9, wherein each suction extraction shoe 126 is structured for accomplishing the "washboard" scrubbing effect of the moveable target surface, i.e. carpet surface, independently of the next consecutive suction extraction shoe 126. Here, suction extraction shoe 126 is again shown as having functional leading surface 188 and functional trailing surface 190 both as a function of the reversed rotational direction (arrow 158*a*) of rotary surface cleaning tool 124, shown as clockwise in FIG. 24. As shown here, leading surface 188 is shown by example and without limitation as having optional relatively lower or recessed portion 194, while trailing surface 190 is shown as having optional raised portion 192 thereof that stands out further from bottom operational surface 172 of rotary surface cleaning tool 124 than relatively lower or recessed leading surface portion 194.

When optional recessed portion 194 and raised portion 192 of suction extraction shoe 126 are present on leading surface 188 and trailing surface 190, respectively, the relative difference in height of recessed leading portion 194 and raised trailing portion 192 combine in each suction extraction shoe 126 to independently operate the "washboard" scrubbing effect of a moveable target surface, i.e. carpet surface, wherein up-down oscillations of the moveable carpet are caused by alternate application of vacuum suction and shoe compression of carpet 57. In other words, the target carpet 57 is initially sucked up toward recessed leading portion 194 of suction extraction shoe 126 by the action of suction or vacuum extraction passage 136, and then squeezed back down by optional raised trailing portion 192 of trailing surface 190 of the same suction extraction shoe 126, as illustrated in FIG. 24. Each consecutive suction extraction shoe 126 operates independently of the other suction extraction shoes 126 of rotary surface cleaning tool 124 to operate suction or vacuum extraction passage 136 to initially suck up the target carpet 57 toward recessed leading portion 194, before the raised trailing portion 192 of the same suction extraction shoe 126 consecutively compresses the target carpet 57 back down toward the underlying floor surface. This alternate vacuum suction and shoe compression of carpet 57 is repeated independently by each consecutive suction extraction shoe 126. Since rotary surface cleaning tool 124 turns at a high speed rotary motion these up-down oscillations of the moveable carpet are repeated at least one or several times each second, which results in significantly aggressive agitation of the target carpet 57 in combination with the fluid cleaning.

Additionally, suction extraction shoe 126 is illustrated having a plurality of shallow vacuum or suction relief grooves 216 formed across relatively raised portion 192 thereof and oriented substantially perpendicular to suction extraction passages 136. Suction relief grooves 216 are formed across either leading surface 188 or trailing surface 190 as a function of the counterclockwise or clockwise rotary motion (arrows 158, 158*a*) of cleaning tool 124. As disclosed herein, suction extraction passages 136 are oriented substantially radially with respect to cleaning tool operational surface 172 and substantially perpendicular to the counterclockwise or clockwise rotary motion (arrows 158, 158*a*) of cleaning tool 124, whereby suction relief grooves 216 lie substantially along the rotary motion (arrows 158, 158*a*) of cleaning tool 124. Suction relief grooves 216 formed across relatively raised portion 192 of suction extraction shoe 126 and oriented substantially radially with respect to cleaning tool operational surface 172 and along the rotary motion (arrows 158, 158*a*) of cleaning tool 124 provide the advantages disclosed herein. Suction relief grooves 216 permit suction extraction passages 136 of suction extraction shoes 126 to be positioned as near to the rug 57 or floor as possible for maintaining the vacuum force supplied by the fluid cleaning system for maximizing airflow to promote drying, while preventing vacuum lock-up and ensuring mobility on the one hand.

Again, as disclosed herein, the quantity and actual dimensions of suction relief grooves 216 on suction extraction shoes 126 are subject to such factors as the size and number of suction extraction shoes 126 on operational surface 172 of rotary cleaning tool 124, the width and length dimensions of suction extraction passages 136, and the vacuum force generated by the suction source, as well as the rotational velocity of cleaning tool operational surface 172. When relatively raised portion 192 is present in contrast to relatively lower or recessed portion 194 as shown, the resulting height difference between leading surface 188 and trailing surface 190 also affects the quantity and actual dimensions of suction relief grooves 216 on suction extraction shoes 126. Optionally, suction relief grooves 216 are also optionally positioned on relatively raised portion 192 of either of leading surface 188 or trailing surface 190 of suction extraction shoes 126. The size, quantity, relative positioning and distribution and of suction relief grooves 216 is a function of all these factors, but can be determined for any rotary surface cleaning machine 100 without undue experimentation.

FIG. 23 is a detailed cross-section view of the embodiment of suction extraction shoe 126 illustrated in FIG. 22, wherein suction extraction shoe 126 is shown as having leading surface 188 and trailing surface 190 as a function of the reversed clockwise rotational direction (arrow 158*a*) of rotary surface cleaning tool 124. As shown here, leading surface 188 is shown by example and without limitation as having optional relatively lower or recessed portion 194, while trailing surface 190 is formed with relatively raised portion 192 thereof that stands out further from bottom operational surface 172 of rotary surface cleaning tool 124 than relatively lower or recessed portion 194 of leading surface 188.

FIG. 24 illustrates bottom operational surface 172 of rotary surface cleaning tool 124 of the rotary surface cleaning machine 100 illustrated in FIG. 5 through FIG. 9, having suction extraction shoe 126 with relatively lower or recessed surface portion 194 formed on leading surface 188, and optional raised surface portion 192 formed on trailing surface 190 as illustrated in FIG. 22 and FIG. 23. Here, rotational direction of rotary surface cleaning tool 124 is reversed, whereby rotary cleaning tool 124 operates in a clockwise direction (arrow 158*a*) in contrast to the counterclockwise direction 158 illustrated in FIG. 15. As illustrated here, optional relatively recessed portion 194 is positioned on leading surface 188 of suction extraction shoe 124, while relatively raised portion 192 is positioned on trailing surface 190 as a function of the reversed clockwise rotational direction (arrow 158*a*). Accordingly, the "washboard" scrubbing effect of the moveable target carpet 57 is accomplished by each suction extraction shoe 126 as a function of the combination therein of recessed portion 194 of leading surface 188 and raised portion 192 of trailing surface 190 in turn engaging the movable target carpet 57.

While the preferred and additional alternative embodiments of the invention have been illustrated and described, it will be appreciated that various changes can be made therein without departing from the spirit and scope of the invention. Therefore, it will be appreciated that various changes can be made therein without departing from the spirit and scope of the invention. Accordingly, the inventor makes the following claims.

What is claimed is:

1. A rotary surface cleaning machine, comprising:

a rotary surface cleaning tool coupled for high speed rotary motion relative to a frame member and further comprising a substantially circular operational surface;

a high speed rotary driving means coupled for driving a high speed rotary motion of the rotary surface cleaning tool;

a plurality of individual arrays of cleaning solution delivery spray nozzles being substantially uniformly angularly distributed across the operational surface of the rotary surface cleaning tool, the arrays of spray nozzles being coupled in fluid communication with a pressurized flow of cleaning fluid through a plurality of individual liquid cleaning fluid distribution channels of a cleaning fluid distribution manifold portion of the rotary surface cleaning tool; and a plurality of suction extraction shoes being substantially uniformly angularly distributed across the operational surface of the rotary surface cleaning tool alternately between the arrays of cleaning solution delivery spray nozzles and being projected from the operational surface of the rotary surface cleaning tool by a biasing means structured for individually biasing each suction extraction shoe outwardly relative to bottom operational surface of the rotary surface cleaning tool, and each of the suction extraction shoes further comprising a fluid extraction passage presented adjacent to the operational surface of the rotary surface cleaning tool and oriented substantially radially of the operational surface of the rotary surface cleaning tool, each of the fluid extraction passages communicating through one of a plurality of plenum branch passages with a vacuum plenum that is in fluid communication with a vacuum suction source, and wherein an operational surface of each suction extraction shoe further comprises a plurality of suction relief grooves formed thereacross and oriented crosswise of the fluid extraction passage thereof.

2. The rotary surface cleaning machine of claim 1, wherein each of the plurality of individual arrays of cleaning solution delivery spray nozzles further comprises a plurality of individual delivery spray nozzles that are radially oriented across the substantially circular operational surface of the rotary surface cleaning tool, and wherein each individual array of the spray nozzles extends across a portion of the operational surface that is substantially less than an annular portion thereof extended between an inner radial limit and an outer radial limit, and wherein individual ones of the arrays of spray nozzles are positioned in a substantially spiral pattern across the annular portion of the operational surface of the rotary surface cleaning tool between the inner radial limit of the annular portion and receding therefrom over the annular portion toward the outer radial limit thereof.

3. The rotary surface cleaning machine of claim 1, wherein one or more of the plurality of suction extraction shoes further comprises a functional leading surface portion and a functional trailing surface portion as a function of a direction of the rotary motion of the operational surface of the rotary surface cleaning tool, one of the functional leading and trailing surface portions further comprising a relatively raised surface portion of the suction extraction shoe that projects further from the operational surface of the rotary surface cleaning tool than a relatively lower surface portion thereof, the relatively raised surface portion of each suction extraction shoe further comprising the plurality of suction relief grooves are further formed thereacross and further forming a target surface scrubbing means for causing a washboard-type scrubbing effect of a moveable target surface to be cleaned, wherein the target surface scrubbing means causes oscillations of the moveable target surface alternately toward and away from the operational surface of the rotary surface cleaning tool by alternate application of vacuum suction and compression thereof.

4. The rotary surface cleaning machine of claim 3, wherein the relatively raised surface portion of each suction extraction shoe further comprises the leading surface portion of the suction extraction shoe, and the relatively lower surface portion further comprises the trailing surface portion thereof.

5. The rotary surface cleaning machine of claim 2, wherein each individual array of spray nozzles extends across a radial portion of the annular portion that is a portion about the same radial extension as the annular portion divided by the number of individual array of spray nozzles.

6. The rotary surface cleaning machine of claim 2, wherein the annular portion is further substantially radially coextensive with a radial length of the fluid extraction passages of the suction extraction shoes.

* * * * *